US010876686B2

(12) United States Patent
Ramoo et al.

(10) Patent No.: US 10,876,686 B2
(45) Date of Patent: Dec. 29, 2020

(54) STORAGE TANK CONTAINMENT SYSTEM

(71) Applicant: Altair Engineering, Inc., Troy, MI (US)

(72) Inventors: Regu Ramoo, Ashburn, VA (US); Thomas Lamb, Lynnwood, WA (US)

(73) Assignee: Altair Engineering, Inc., Troy, MI (US)

( * ) Notice: Subject to any disclaimer, the term of this patent is extended or adjusted under 35 U.S.C. 154(b) by 131 days.

(21) Appl. No.: 16/117,281

(22) Filed: Aug. 30, 2018

(65) Prior Publication Data

US 2019/0063682 A1 Feb. 28, 2019

Related U.S. Application Data

(60) Provisional application No. 62/552,917, filed on Aug. 31, 2017.

(51) Int. Cl.

| | |
|---|---|
| ***F17C 3/00*** | (2006.01) |
| ***F17C 13/08*** | (2006.01) |
| ***F17C 1/00*** | (2006.01) |

(52) U.S. Cl.

CPC ..... *F17C 3/00* (2013.01); *F17C 1/002* (2013.01); *F17C 13/08* (2013.01);

(Continued)

(58) Field of Classification Search

CPC ..... F17C 3/00; F17C 1/002; F17C 13/082; F17C 13/08; B65D 88/04; B65D 7/44; B65D 11/22

(Continued)

(56) References Cited

U.S. PATENT DOCUMENTS

| | | | |
|---|---|---|---|
| 965,455 | A | 7/1910 | Harry |
| 1,769,831 | A | 7/1930 | Gramm |

(Continued)

FOREIGN PATENT DOCUMENTS

| | | |
|---|---|---|
| CN | 2299219 | 12/1998 |
| CN | 201411172 | 2/2010 |

(Continued)

OTHER PUBLICATIONS

International Search Report and Written Opinion for Intl App No. PCT/US2018/048706, dated Oct. 30, 2018 (13 pages).

(Continued)

*Primary Examiner* — Robert J Hicks

(74) *Attorney, Agent, or Firm* — Fish & Richardson P.C.

(57) ABSTRACT

An example tank can be used to contain, transport, and/or store fluids, e.g., one or more liquids and/or gases. In one embodiment, the tank includes a plurality of segments collectively defining an interior chamber that retains the fluid(s), each of which includes opposing ends defining beveled mating surfaces. The tank also includes a plurality of endcaps positioned between, and in engagement with, adjacent segments, as well as a plurality of webs that include a series of first webs having a first configuration and a series of second webs having a second, different configuration. The first webs are positioned within the plurality of segments between the ends thereof, and the second webs are positioned within the endcaps. In an alternate embodiment, the tank is devoid of the endcaps, and instead, includes segments defining beveled mating surfaces that intersect at junctures to define four corner sections of the tank.

11 Claims, 14 Drawing Sheets

(52) U.S. Cl.
CPC ..... *F17C 2201/0128* (2013.01); *F17C 2201/0133* (2013.01); *F17C 2201/0157* (2013.01); *F17C 2201/035* (2013.01); *F17C 2201/052* (2013.01); *F17C 2201/054* (2013.01); *F17C 2203/012* (2013.01); *F17C 2203/013* (2013.01); *F17C 2203/0639* (2013.01); *F17C 2203/0646* (2013.01); *F17C 2203/0648* (2013.01); *F17C 2203/0685* (2013.01); *F17C 2205/018* (2013.01); *F17C 2221/033* (2013.01); *F17C 2223/0161* (2013.01); *F17C 2223/033* (2013.01); *F17C 2265/066* (2013.01); *F17C 2270/011* (2013.01); *F17C 2270/0105* (2013.01)

(58) Field of Classification Search
USPC ..... 220/566, 565, 654, 651, 639
See application file for complete search history.

(56) References Cited

U.S. PATENT DOCUMENTS

| | | | | |
|---|---|---|---|---|
| 2,593,408 | A * | 4/1952 | Boardman | B65D 88/02 220/565 |
| 2,673,001 | A | 3/1954 | Ulm et al. | |
| 2,675,940 | A | 4/1954 | Ewald | |
| 3,088,622 | A * | 5/1963 | Ulm | B65D 88/10 220/565 |
| 3,124,265 | A | 3/1964 | Bertels | |
| 3,314,567 | A | 4/1967 | Becker et al. | |
| 3,414,153 | A | 12/1968 | Leroux | |
| 3,612,329 | A | 10/1971 | Parks et al. | |
| 3,912,103 | A | 10/1975 | Helmut | |
| 3,944,106 | A | 3/1976 | Lamb | |
| 4,459,929 | A | 7/1984 | Ffooks | |
| 4,838,449 | A | 6/1989 | Jarnott et al. | |
| 4,946,056 | A | 8/1990 | Stannard | |
| 4,947,988 | A | 8/1990 | Schutz | |
| 4,947,998 | A | 8/1990 | Smeller | |
| 5,462,505 | A | 10/1995 | Blair et al. | |
| 5,624,049 | A | 4/1997 | Kovash et al. | |
| 6,095,367 | A | 8/2000 | Blair et al. | |
| 6,354,457 | B1 | 3/2002 | Aaron | |
| 6,659,303 | B2 | 12/2003 | Garceau | |
| 6,691,889 | B1 | 2/2004 | Falk | |
| 6,971,537 | B2 | 12/2005 | Enright, Jr. | |
| 6,994,104 | B2 | 2/2006 | Bishop et al. | |
| RE41,142 | E | 2/2010 | Blair et al. | |
| 8,020,722 | B2 | 9/2011 | Richards et al. | |
| 8,322,551 | B2 | 4/2012 | Ramoo et al. | |
| 8,851,320 | B2 | 10/2014 | Ramoo et al. | |
| 8,851,321 | B2 | 10/2014 | Ramoo et al. | |
| 9,175,806 | B2 | 11/2015 | Ramoo et al. | |
| 9,321,588 | B2 | 4/2016 | Ramoo et al. | |
| 9,708,120 | B2 | 7/2017 | Ramoo et al. | |
| 2001/0040160 | A1 | 11/2001 | Gulati | |
| 2008/0099489 | A1 | 5/2008 | Ramoo et al. | |
| 2008/0209918 | A1 | 9/2008 | White | |
| 2010/0083671 | A1 | 4/2010 | Liner | |
| 2010/0258571 | A1 | 10/2010 | Ramoo et al. | |
| 2011/0121003 | A1 | 5/2011 | Moir | |
| 2014/0137782 | A1 | 5/2014 | Cho et al. | |
| 2014/0224169 | A1 | 8/2014 | Morimoto | |
| 2015/0021318 | A1 | 1/2015 | Ramoo et al. | |
| 2015/0021341 | A1 | 1/2015 | Ramoo et al. | |
| 2016/0319990 | A1 | 11/2016 | Ramoo et al. | |
| 2019/0331296 | A1 | 10/2019 | Ramoo et al. | |

FOREIGN PATENT DOCUMENTS

| | | | |
|---|---|---|---|
| CN | 104011453 | A | 8/2014 |
| CN | 108349576 | A | 7/2018 |
| JP | S 45-023777 | B | 8/1970 |
| JP | S49-129290 | U | 11/1974 |
| JP | H08-133384 | A | 5/1996 |
| JP | 2004106942 | A | 4/2004 |
| JP | 609679 | B2 | 3/2017 |
| KR | 10-1998-0701861 | | 6/1998 |
| KR | 10-2009-0032087 | | 3/2009 |
| KR | 10-2009-0074045 | | 7/2009 |
| KR | 10-2009-0132225 | | 12/2009 |
| KR | 10-2013-0000472 | | 1/2013 |
| KR | 20140098175 | A | 8/2014 |
| WO | WO 1984/001553 | | 4/1984 |
| WO | WO 2006/001711 | | 1/2006 |
| WO | WO 2008/052149 | | 5/2008 |
| WO | WO 2013/078210 | A1 | 5/2013 |
| WO | WO 2015/068383 | | 5/2015 |
| WO | WO 2017/074313 | A1 | 5/2017 |
| WO | WO 2017/074538 | A1 | 5/2017 |

OTHER PUBLICATIONS

International Preliminary Report on Patentability for Int. App No. PCT/US2016/047382 dated May 1, 2018 (11 pages).
International Search Report and Written Opinion for Int. App No. PCT/US2012/066073 dated Mar. 26, 2013 (8 pages).
International Preliminary Report on Patentability for Int. App No. PCT/US2012/066073 dated May 27, 2014 (5 pages).
International Preliminary Report on Patentability for Intl App No. PCT/US2015/057583, dated May 1, 2018 (7 pages).
International Search Report and Written Opinion for Intl App No. PCT/US2015/057583, dated Jul. 14, 2016 (9 pages).
International Search and Written Opinion for Intl App No. PCT/US2016/047382 dated Nov. 3, 2016 (12 pages).
CN Office Action for CN App No. 201280064580 dated May 15, 2015 (with English translation) (10 pages).
JP Office Action for JP App No. 2014-542571 dated Jun. 30, 2016 (with English translation) (5 pages).
KR Office Action for KR App No. 10-2014-7017198 dated May 9, 2018 (with English translation) (5 pages).
CN Office Action for CN App. No. 201680062642, dated Aug. 14, 2019, 9 pages (with English translation).
JP Office Action in Japanese Appln. No. 2018-519697, dated Sep. 20, 2019, 4 pages (with English translation).
PCT International Preliminary Report on Patentability in International Appln. No. PCT/US2018/048706, dated Mar. 12, 2020, 7 pages.

* cited by examiner

STORAGE TANK CONTAINMENT SYSTEM

CROSS REFERENCE TO RELATED APPLICATIONS

This application claims priority to U.S. Provisional Application No. 62/552,917 filed Aug. 31, 2017, which is incorporated herein by reference in its entirety.

TECHNICAL FIELD

The present disclosure relates to the containment, transport, and storage of fluid(s), and more specifically, to a semi-cubic donut tank system (semi-CDTS) for the containment, transport, and storage of liquids and/or compressed gases, e.g., liquid natural gas (LNG).

BACKGROUND

Industrial storage tanks can be used to contain, transport, and store substances, such as liquids and/or compressed gases. As examples, storage tanks can be used to store fluids at an on-site location, and containment tanks can be used to transport fluids over land or sea.

SUMMARY

In one aspect of the present disclosure, a tank is described for use in the containment, transport, and storage of a fluid, e.g., one or more liquids and/or gases. The tank includes a plurality of segments in communication and collectively defining an interior chamber that is configured and dimensioned to retain the fluid therein, wherein each of the segments includes opposing ends each defining a first mating surface having a beveled configuration. The tank further includes a plurality of endcaps that are positioned between, and in engagement with, the plurality of segments, as well as a plurality of webs that each define an aperture configured and dimensioned to permit flow of the fluid through the aperture. The plurality of webs includes a series of first webs having a first configuration, and a series of second webs having a second, different configuration. The first webs are positioned within the plurality of segments between the opposing ends thereof, and the second webs are positioned within the endcaps.

In certain embodiments, the second webs and the endcaps may correspond in number such that each endcap includes a second web positioned therein.

In certain embodiments, the first webs may be approximately annular in configuration, and the second webs may be approximately elliptical in configuration.

In certain embodiments, the endcaps may define a configuration that is approximately quarter-spherical.

In certain embodiments, the ends of the segments may each further define a second mating surface. In such embodiments, the first mating surfaces may extend at a first angle, e.g., approximately 45°, in relation to the longitudinal axis of the corresponding segment, and the second mating surfaces may extend at a second, different angle, e.g., approximately 90°, in relation to the longitudinal axis of the corresponding segment.

In certain embodiments, the endcaps may define mating surfaces that are configured and dimensioned in correspondence with the second mating surfaces defined by the opposing ends of the segments to facilitate connection of the endcaps to the segments.

In certain embodiments, the plurality of segments may include a first pair of segments each defining a first length, and a second pair of segments each defining a second length. It is envisioned that the first and second lengths may be either approximately equal such that the tank defines an approximately square-shaped transverse cross-sectional configuration, or alternatively, that the second length may be greater than the first length such that the tank defines an approximately rectangular transverse cross-sectional configuration.

In certain embodiments, the segments may be arranged such that the geometrical midpoints of each segment lie in a single geometric plane.

In another aspect of the present disclosure, a tank is described for use in the containment, transport, and/or storage of a fluid, e.g., one or more liquids and/or gases. The tank includes a plurality of segments, a plurality of first webs having a first configuration, and a plurality of second web having a second, different configuration.

The segments include opposing ends each defining a beveled mating surface. The segments are arranged such that the tank includes four corner sections each with a juncture defined by engagement of the beveled mating surfaces of adjacent segments.

The first webs are positioned within the plurality of segments between the opposing ends thereof, and the second webs are positioned in the corner sections, either at the junctures, or adjacent thereto.

In certain embodiments, the first webs may be approximately annular in configuration, and the second webs may be approximately elliptical in configuration.

Each of the segments defines a length extending along a longitudinal axis. In certain embodiments, the beveled mating surfaces defined by the opposing ends of the segments may extend at an angle of approximately 45° in relation to the longitudinal axis of the corresponding segment.

In certain embodiments, the plurality of segments may include a first pair of segments each defining a first length and a second pair of segments each defining a second length. It is envisioned that the first and second lengths may be either approximately equal such that the tank defines an approximately square-shaped transverse cross-sectional configuration, or alternatively, that the second length may be greater than the first length such that the tank defines an approximately rectangular transverse cross-sectional configuration.

In certain embodiments, the tank may further include upper and lower closure plates that are positioned between the plurality of segments. In such embodiments, the closure plates may be separated by a vertical distance. The closure plates and the plurality of segments define an enclosed cavity that is configured and dimensioned to provide additional volume and/or retain boil-off-gas therein.

In certain embodiments, the segments may be arranged such that the geometrical midpoints of each segment lie in a single geometric plane.

In another aspect of the present disclosure, a tank is described for use in the containment, transport, and storage of a fluid, e.g., one or more liquids and/or gases. The tank includes a plurality of individual segments each defining a midpoint, and is configured and dimensioned such that the midpoints of each segment lie in a single geometric plane.

Each segment of the tank defines a length, a width, and a height. The segments are arranged such that the lengths of at least two of the segments extend along intersecting axes, e.g., axes that are perpendicular in relation to one another.

In certain embodiments, the tank may be configured and dimensioned as an independent, free-standing structure that is supportable on a surface, e.g., the deck, in a machinery space or a hold space of a vessel, on land, or on a barge. The segments are configured, dimensioned, and oriented such that the lengths and the widths thereof extend along respective first and second axes that are approximately parallel in relation to the surface, e.g., the deck of a cargo hold, and the height thereof extends along a third axis that is approximately orthogonal in relation to the first and second axes. In certain embodiments, the height of each segment may be less than the length.

One or more of the embodiments described herein can provide a variety of benefits. As an example, one or more of the features described herein can be incorporated into containment, transport, and storage systems to increase the spatial and structural efficiencies of the system. Accordingly, these systems can be smaller, more lightweight, and/or more adaptable to the spatial restrictions of transport vessels of various sizes, and can be used in a wider array of environments and conditions.

DETAILED DESCRIPTION

The present disclosure relates to a tank for use in the containment, transport, and storage of a fluid, e.g., one or more liquids and/or gases. The presently disclosed tank includes a series of hollow segments that collectively retain the fluid and is designed to be smaller, lighter, and more flexible in terms of spatial requirements when compared to known systems. The present disclosure contemplates several design alternatives. For example, one design includes a series of curvate, quarter-spherical endcaps positioned between adjacent segments, which allows for higher pressure thresholds, thereby eliminating the need for any auxiliary means of evacuation of boil-off-gas. In another design, however, which is intended to operate at lower pressures, the tank is devoid of the aforementioned endcaps, and instead, includes corner joints defined by the engagement of adjacent segments. To increase structural rigidity, and attenuate dynamic movement ("sloshing") of fluid within the tanks during movement/transport, each embodiment of the tanks described herein allows for the incorporation of internal webs. Dependent upon the particular requirements of the tank, e.g., the dimensions of the intended physical location on a vessel, it is envisioned that the tanks may assume any suitable geometrical configuration, e.g., the tanks may be square-shaped, rectangular-shaped, etc. Various embodiments of the present disclosure will now be described in detail with reference to the figures, wherein like references numerals identify similar or identical elements.

Figure 1:
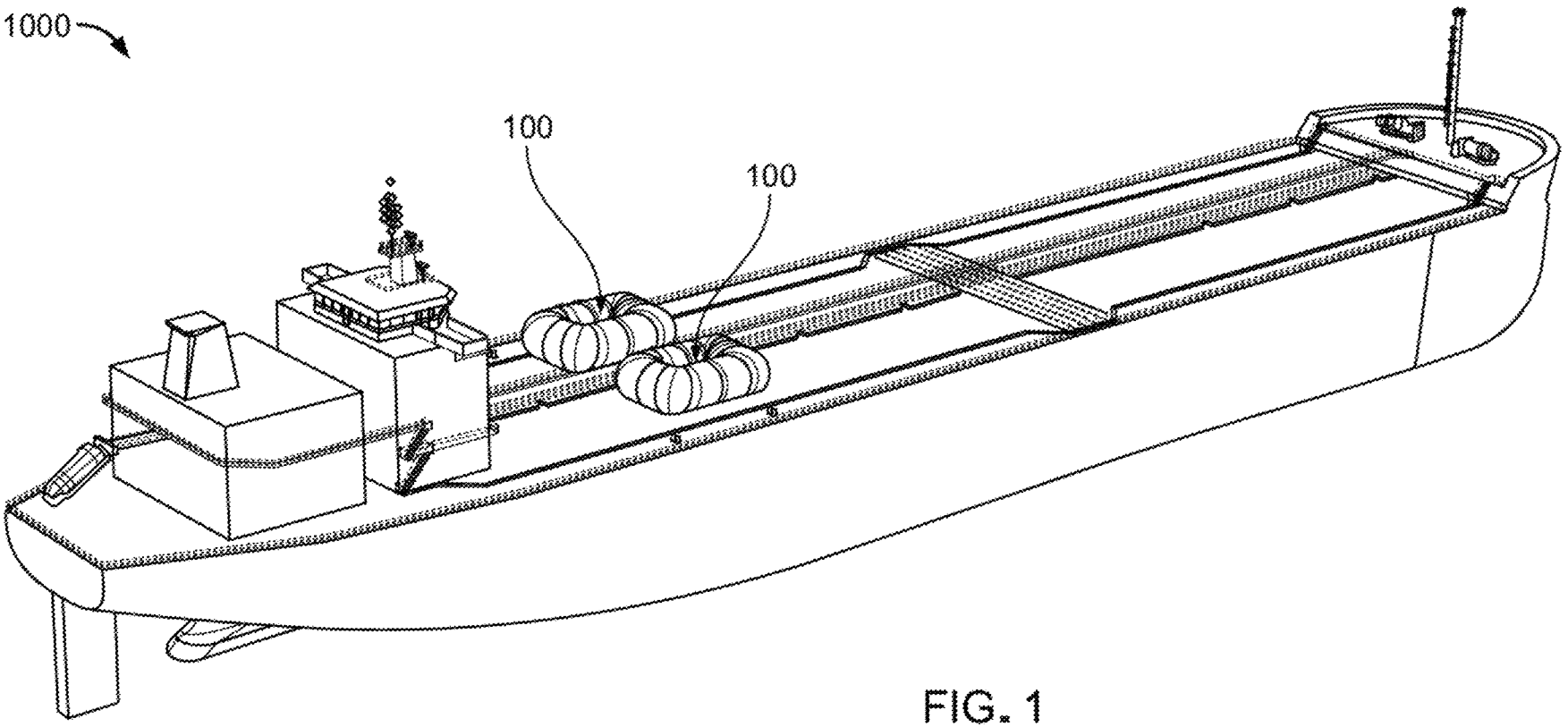
FIG. 1 is a top, perspective view of a vessel including a plurality of tanks in accordance with the principles of the present disclosure.

FIG. 1 illustrates a transport vessel 1000 including a plurality of storage tanks 100 that are configured as independent, free-standing structures supportable on a surface of the vessel 1000, e.g., the main deck. Although illustrated as a tanker, it should be appreciated that the principles of the present disclosure would be equally applicable to a variety of transport vessels, such as an aircraft, a train, etc.

Figure 2:
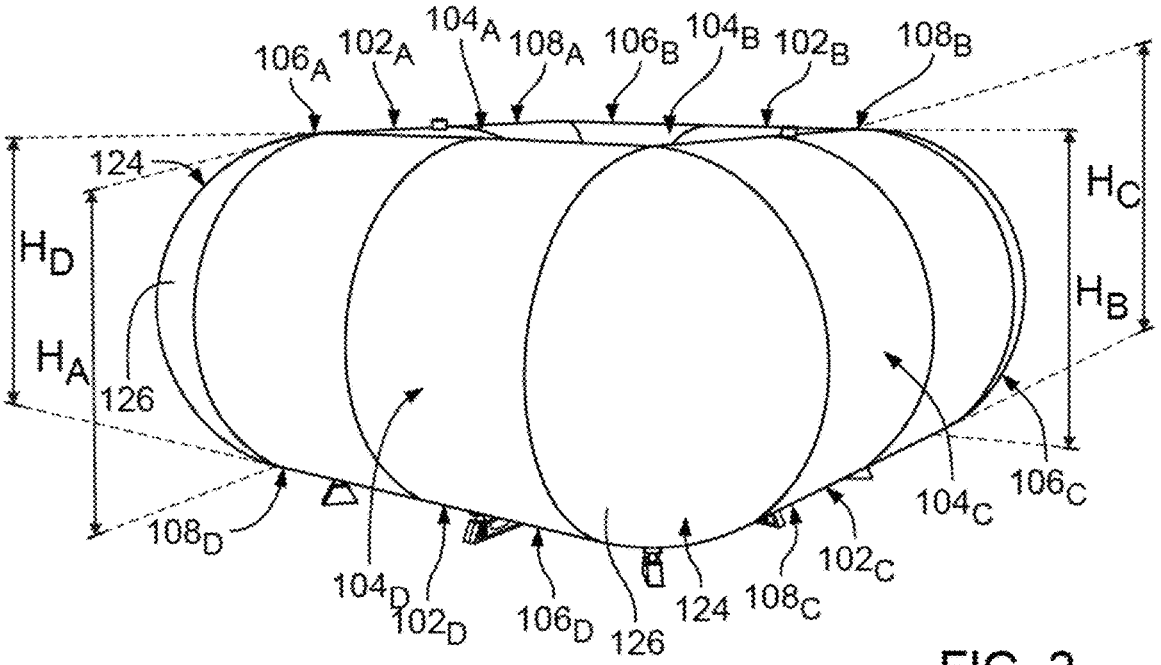
FIG. 2 is a top, perspective view of an exemplary tank in accordance with the principles of the present disclosure including a plurality of segments, and a plurality of endcaps positioned between adjacent segments.
Figure 4:
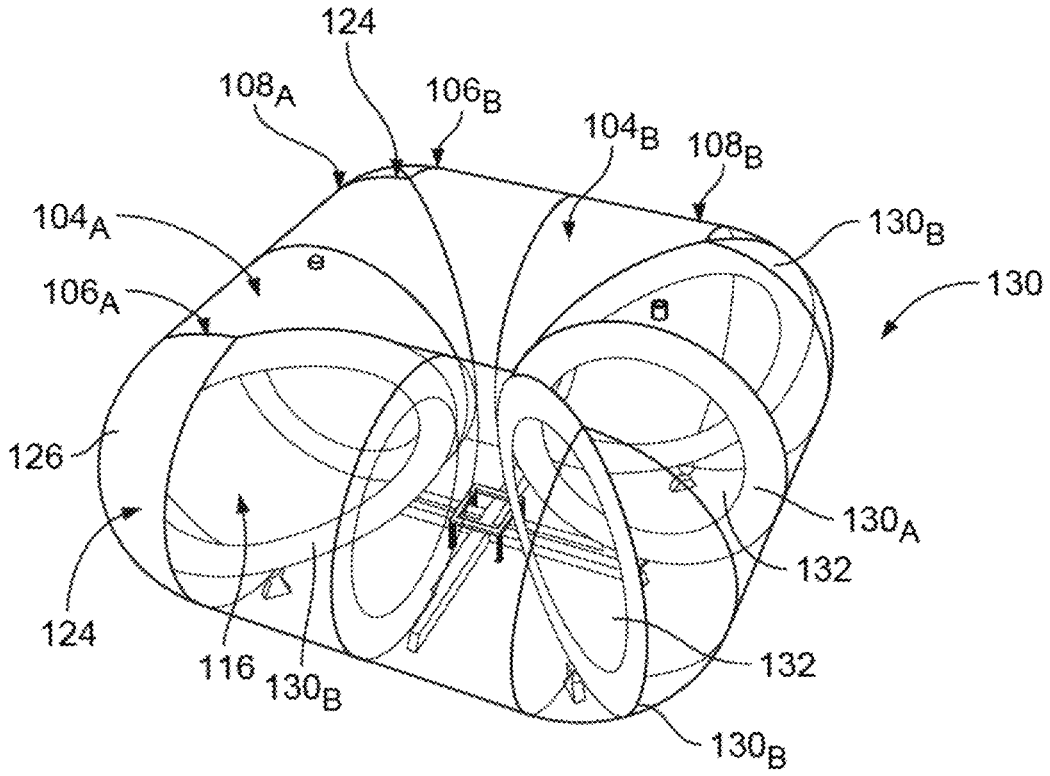
FIG. 4 is a top, perspective view of the tank seen in FIG. 2 with two segments shown in phantom.
Figure 5:
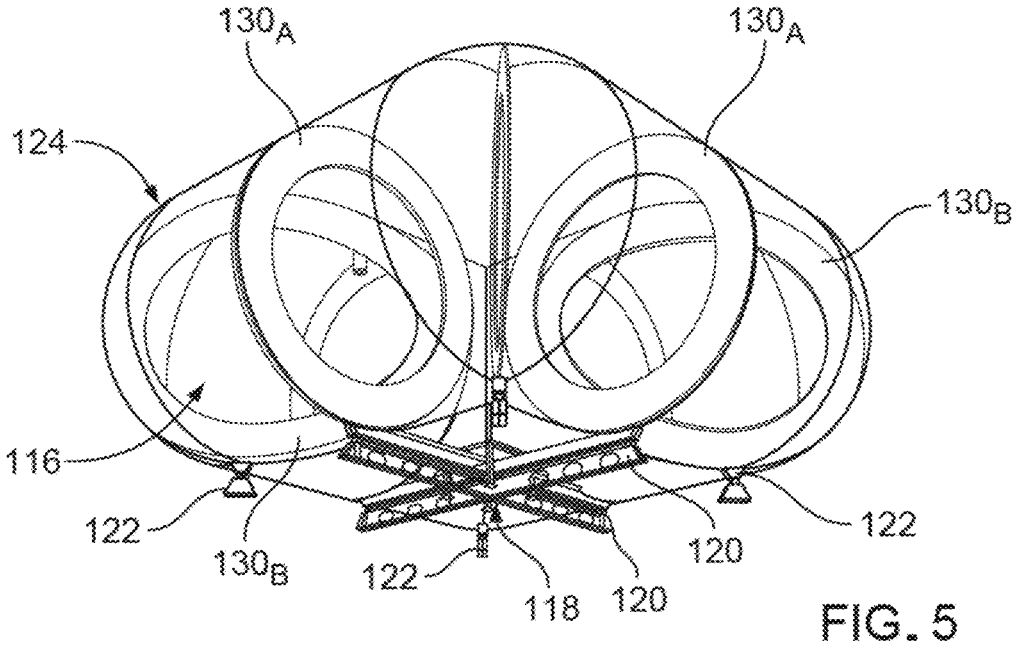
FIG. 5 is a bottom, perspective view of the tank seen in FIG. 2 with two segments shown in phantom.
Figure 6:
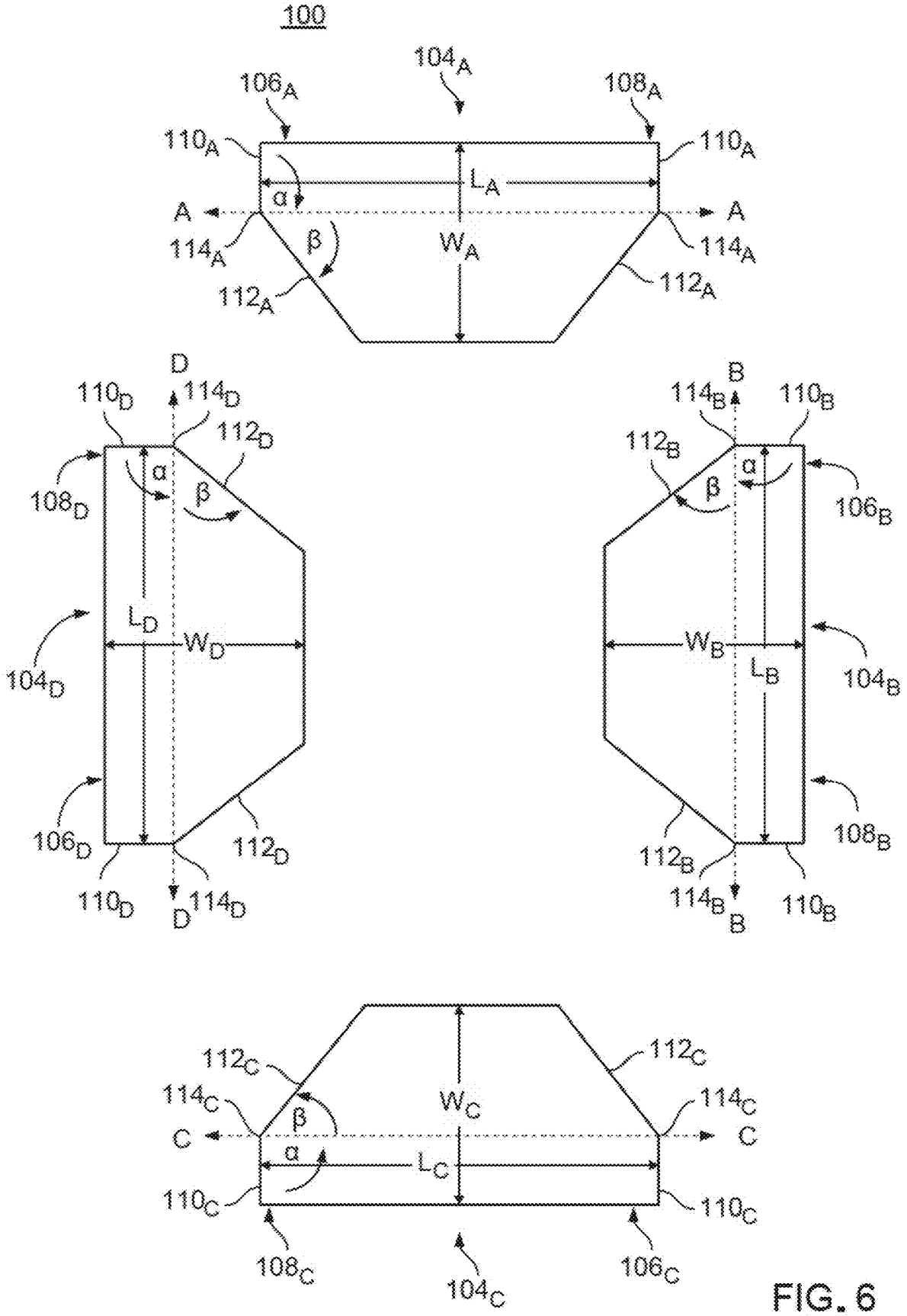
FIG. 6 is a partial, top, schematic view of the tank seen in FIG. 2 with the endcaps removed.

Referring now to FIGS. 2-13, the tanks 100 include four sides $\mathbf{102}_{A\text{-}D}$ (FIG. 2) defined by hollow segments $\mathbf{104}_{A\text{-}D}$. Each segment $\mathbf{104}_{A\text{-}D}$ defines a length L (FIG. 6), a width W (FIG. 6), and a height H (FIG. 2). Specifically, the segment $\mathbf{104}_A$ defines a length $L_A$, a width $W_A$, and a height $H_A$, the segment $\mathbf{104}_B$ defines a length $L_B$, a width $W_B$, and a height $H_B$, the segment $\mathbf{104}_C$ defines a length $L_C$, a width $W_C$, and a height $H_C$, and the segment 104*b* defines a length $L_D$, a width $W_D$, and a height $H_D$. As seen in FIG. 6, for example, the segments $\mathbf{104}_{A\text{-}D}$ are arranged such that the lengths L of adjacent segments 104 extend along intersecting axes, e.g., axes that are perpendicular in relation to each other. Specifically, the length $L_A$ of segment $\mathbf{104}_A$ extends along axis A-A, which intersects axes B-B and D-D defined by the lengths $L_B$, $L_D$ of segments $\mathbf{104}_B$, $\mathbf{104}_D$, respectively. Similarly, the length $L_C$ of segment $\mathbf{104}_C$ extends along an axis C-C, which intersects axes B-B, D-D defined by the lengths $L_B$, $L_D$ of segments $\mathbf{104}_B$, $\mathbf{104}_D$, respectively. Moreover, the segments 104 are configured and dimensioned such that the lengths L and the widths W thereof extend along axes that are generally parallel in relation to the surface on which the tanks 100 are supported, e.g., the deck of the vessel 1000 (FIG. 1), and the heights H (FIG. 2) thereof extend along axes that are generally orthogonal in relation to the surface. In the embodiment seen in FIGS. 2-13, the segments 104 are configured and dimensioned such that the height H of each segment 104 is less than the length L. In various embodiments of the disclosure, dependent upon the particular intended use of the tanks 100, it is contemplated that the width W of each segment 104 may be equivalent to, or different from, the length L and/or the height H of the segment 104.

Figure 7:
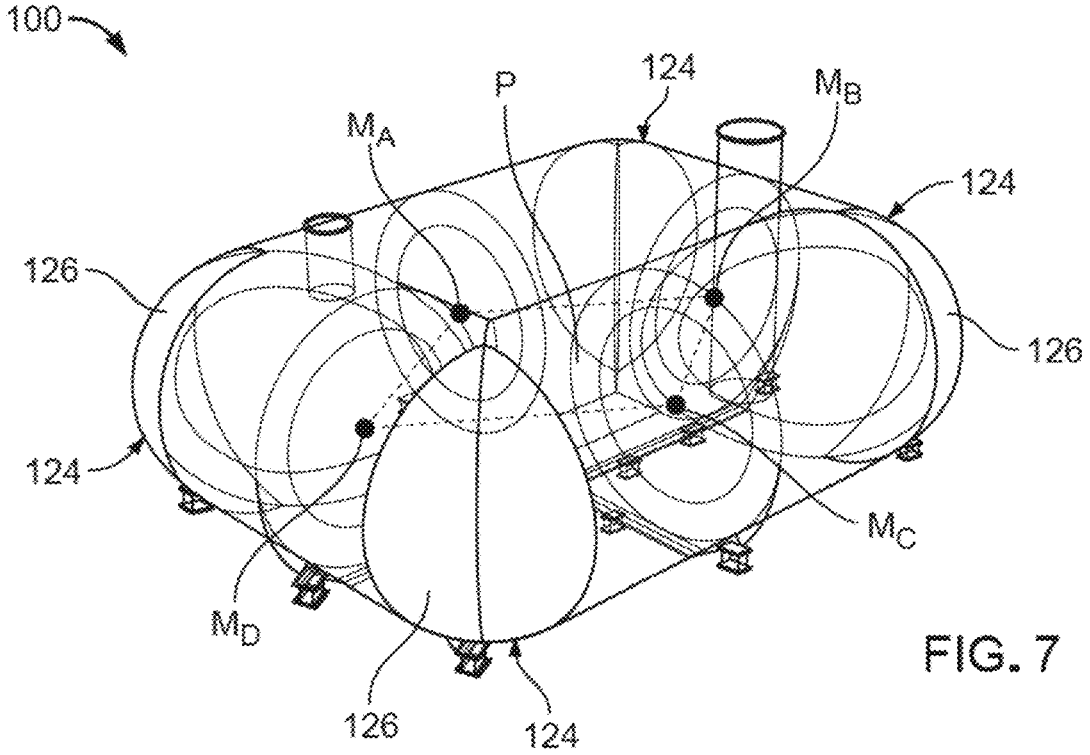
FIG. 7 is a top, perspective view of the tank seen in FIG. 2 with the segments shown in phantom.

As seen in FIG. 7, each segment $\mathbf{104}_{A\text{-}D}$ defines a geometrical midpoint "M." Specifically, the segment $\mathbf{104}_A$ defines a geometrical midpoint $M_A$, the segment $\mathbf{104}_B$ defines a geometrical midpoint $M_B$, the segment $\mathbf{104}_C$ defines a geometrical midpoint $M_C$, and the segment $\mathbf{104}_D$ defines a geometrical midpoint $M_D$. The tanks 100 are configured and dimensioned in a manner whereby the midpoints $M_{A\text{-}D}$ of each segment $\mathbf{104}_{A\text{-}D}$ lie in a single geometric plane "P."

As seen in FIG. 6, each segment $\mathbf{104}_{A\text{-}D}$ includes opposing ends $\mathbf{106}_{A\text{-}D}$, $\mathbf{108}_{A\text{-}D}$. Specifically, segment $\mathbf{104}_A$ includes opposing ends $\mathbf{106}_A$, $\mathbf{108}_A$, segment $\mathbf{104}_B$ includes opposing ends $\mathbf{106}_B$, $\mathbf{108}_B$, segment $\mathbf{104}_C$ includes opposing ends $\mathbf{106}_C$, $\mathbf{108}_C$, and segment $\mathbf{104}_D$ includes opposing ends $\mathbf{106}_D$, $\mathbf{108}_D$. Although the segments $\mathbf{104}_{A\text{-}D}$ are shown as having a generally circular cross-sectional configuration (FIGS. 2-5) throughout the figures, and thus as being tubular or cylindrical structures, it should be appreciated that the cross-sectional configuration of the segments $\mathbf{104}_{A\text{-}D}$ may be varied in alternate embodiments without departing from the scope of the present disclosure. For example, it is envisioned that the segments $\mathbf{104}_{A\text{-}D}$ may define a more elliptical cross-sectional configuration.

With continued reference to FIG. 6, each end $\mathbf{106}_{A\text{-}D}$, $\mathbf{108}_{A\text{-}D}$ of the segments $\mathbf{104}_{A\text{-}D}$ defines a pair of mating surfaces $\mathbf{110}_{A\text{-}D}$, $\mathbf{112}_{A\text{-}D}$ that intersect to define edges $\mathbf{114}_{A\text{-}D}$. Each of the mating surfaces $\mathbf{110}_{A\text{-}D}$ are identical in configuration, as are the mating surfaces $\mathbf{112}_{A\text{-}D}$, to facilitate assembly of the tanks 100 in the manner discussed below.

The mating surfaces $\mathbf{110}_{A\text{-}D}$, $\mathbf{112}_{A\text{-}D}$ extend so as to subtend angles α, β with the longitudinal axis (A-A, B-B, C-C, D-D) of the corresponding segments $\mathbf{104}_{A\text{-}D}$, respectively. In the particular embodiment of the tanks 100 seen in FIGS. 2-13, the segments $\mathbf{104}_{A\text{-}D}$ are configured and dimensioned such that the angle α is approximately 90° and the angle β is approximately 45°, whereby the mating surfaces $\mathbf{112}_{A\text{-}D}$ define a beveled configuration. It should be appreciated, however, that the configuration of the segments $\mathbf{104}_{A\text{-}D}$ may be varied in alternate embodiments of the disclosure to achieve any desired or suitable values for the angles α, β.

The segments $\mathbf{104}_{A\text{-}D}$ are oriented at approximately right angles to one another, and are in fluid communication to collectively define an interior storage chamber 116 (FIGS. 4, 5) that is configured and dimensioned for the containment of fluids maintained at or above atmospheric pressure. Throughout the present disclosure, the tanks 100 are described as being configured, dimensioned, and/or adapted to contain liquid natural gas (LNG), and may include any material(s) of construction suitable for this intended purpose, e.g., cryogenic grade aluminum such as 5083-O or cryogenic grade steel such as 7% or 9% or 36% nickel-steel, either individually, or in combination. In alternate embodiments of the disclosure, however, the tanks 100 may be configured, dimensioned, and/or adapted to contain other fluids, such as crude oil, liquid oxygen, etc., as would be appreciated by those skilled in the art.

In the particular embodiment of the tanks 100 show in FIGS. 2-13, each of the segments $\mathbf{104}_{A\text{-}D}$ is identical, and thus, defines an equivalent length L, whereby the tanks 100 define a generally "square-shaped" transverse cross-sectional configuration, i.e., a cross-section taken along a plane generally parallel in relation to the surface supporting the tanks 100, such as the plane "P" seen in FIG. 7. In alternate embodiments of the tanks 100, however, the dimensions of the segments $\mathbf{104}_{A\text{-}D}$ may be varied to achieve any desired configuration for the tanks 100. For example, the lengths $L_B$, $L_D$ of segments $\mathbf{104}_B$, $\mathbf{104}_D$ may exceed the lengths $L_A$, $L_C$ of segments $\mathbf{104}_A$, $\mathbf{104}_C$, respectively, such that the tank 100 defines a transverse cross-sectional configuration that is generally "rectangular," as can be appreciated through reference to FIGS. 14-17.

Figure 3:
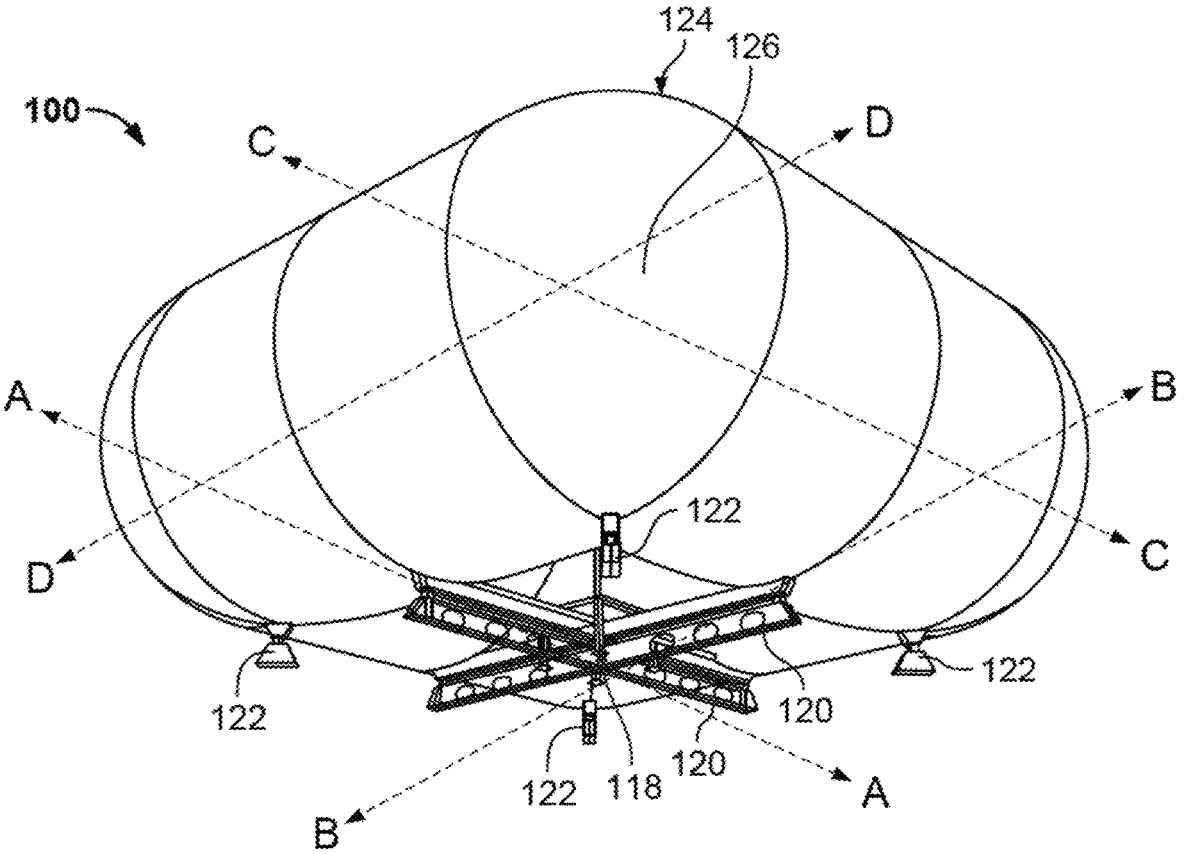
FIG. 3 is a bottom, perspective view of the tank seen in FIG. 2.

With reference now to FIGS. 3 and 5, the tanks 100 are supported by a base structure 118 that includes transverse and longitudinal support members 120, e.g., bulkheads or braces, as well as support blocks 122 to carry the weight of each tank 100, as described in U.S. Patent Publication No. 2016/0319990, the entire contents of which are incorporated herein by reference.

Figure 8:
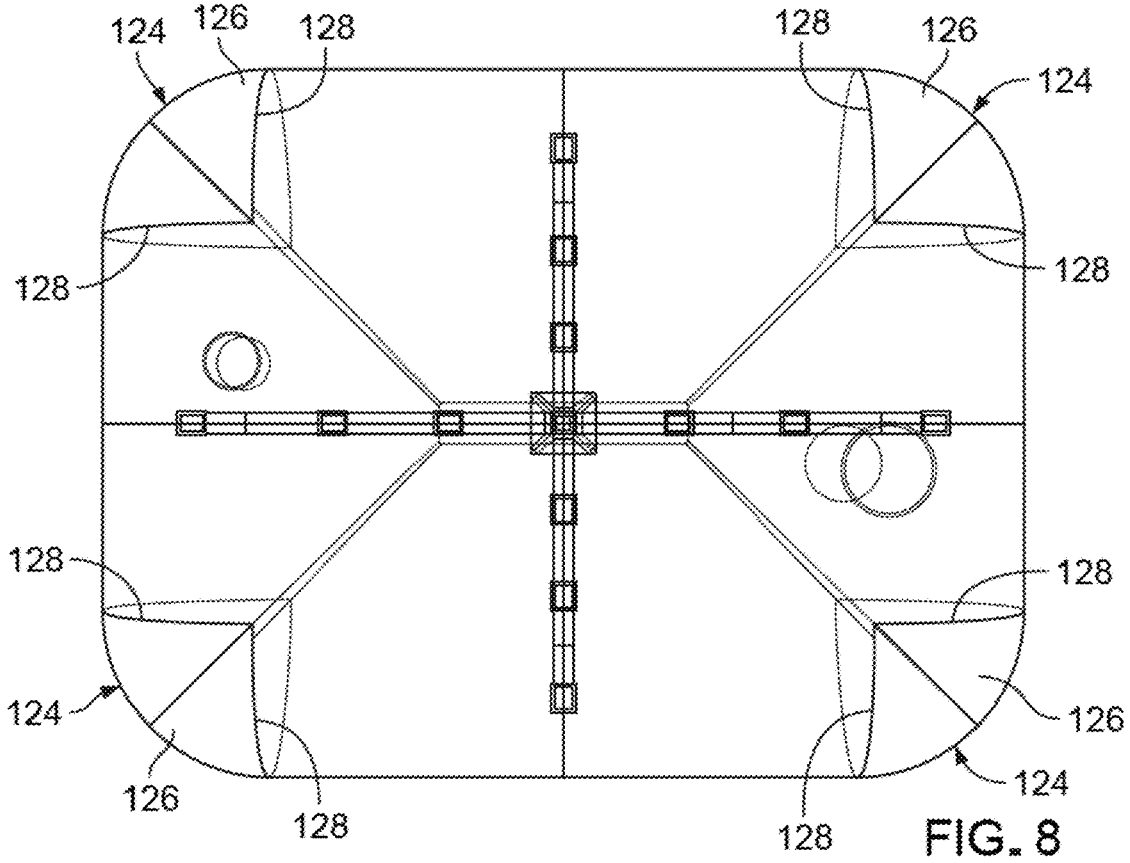
FIG. 8 is a bottom view of the tank seen in FIG. 2 with the segments shown in phantom.
Figure 9:
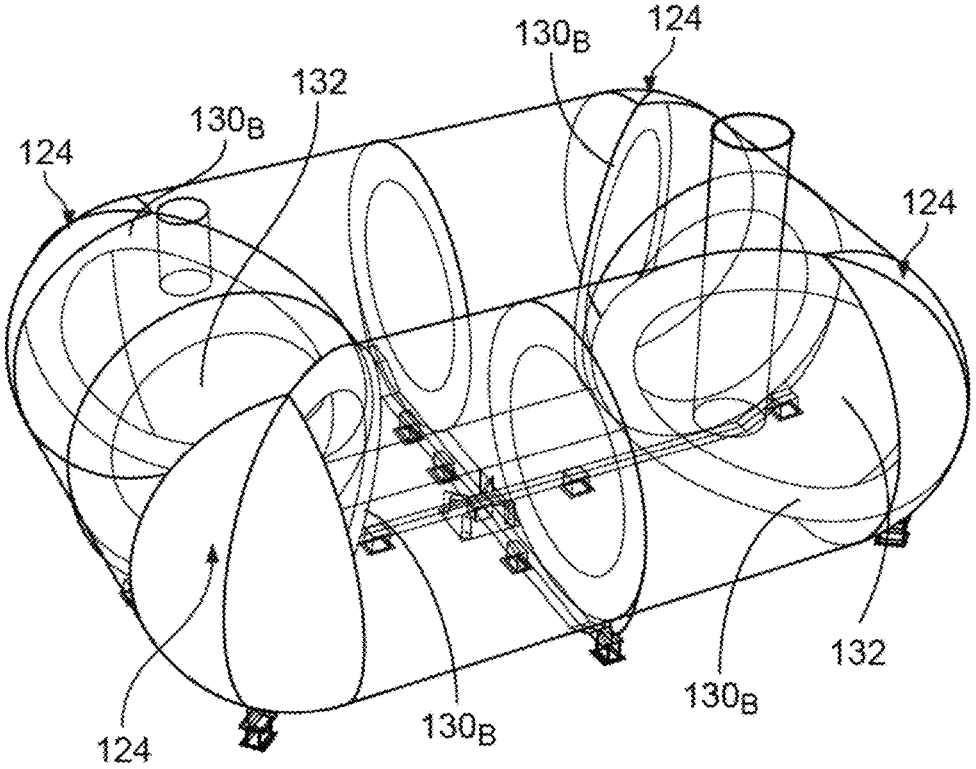
FIG. 9 is a top, perspective view of the tank seen in FIG. 2 with the segments shown in phantom.
Figure 10:
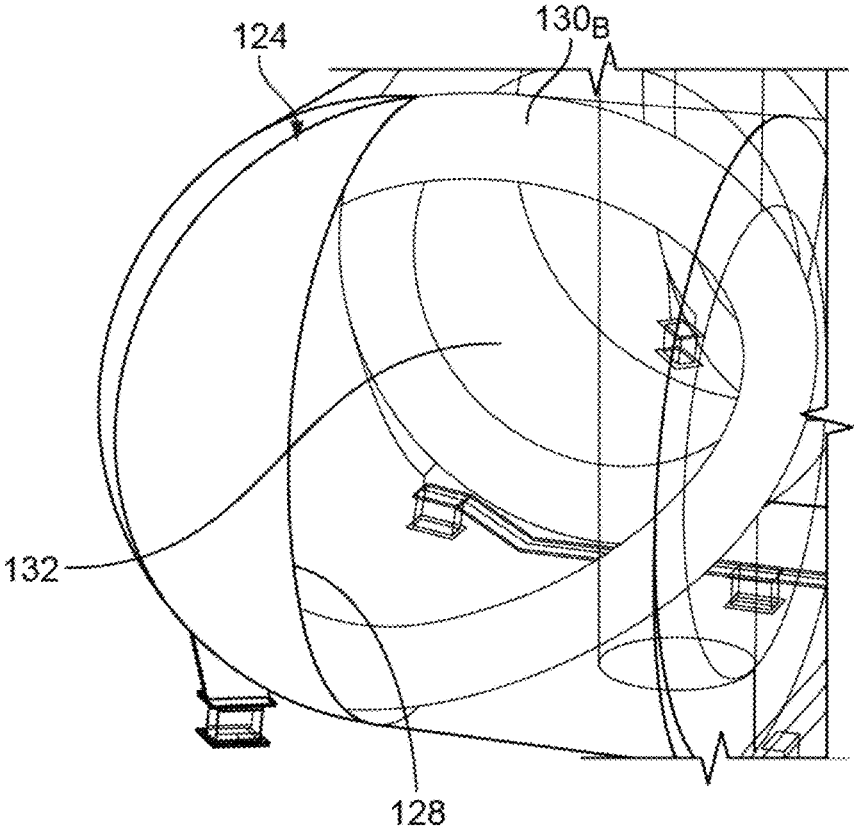
FIG. 10 is a partial, perspective view of the tank seen in FIG. 2 with the segments shown in phantom.
Figure 11:
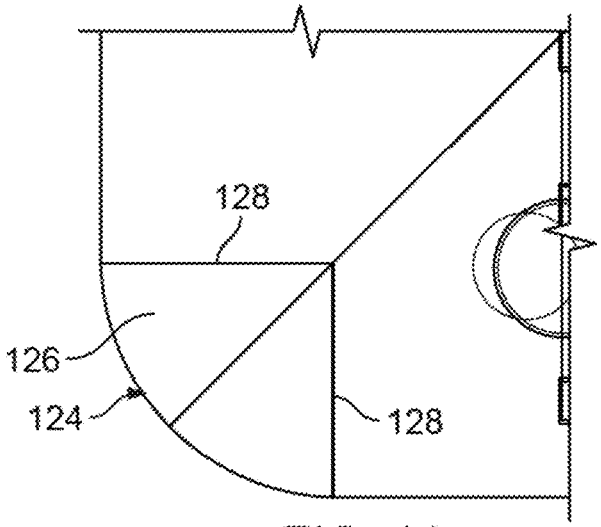
FIG. 11 is a partial, top view of the tank seen in FIG. 2 with the segments shown in phantom.
Figure 12:
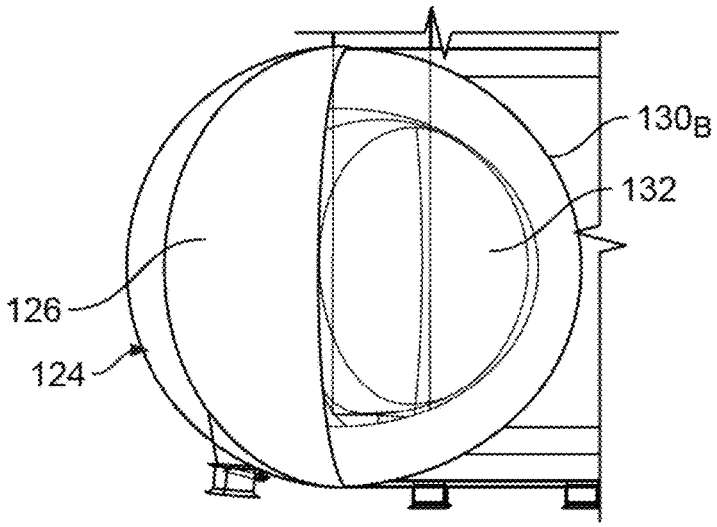
FIG. 12 is a partial, side view of the tank seen in FIG. 2 with the segments shown in phantom.
Figure 13:
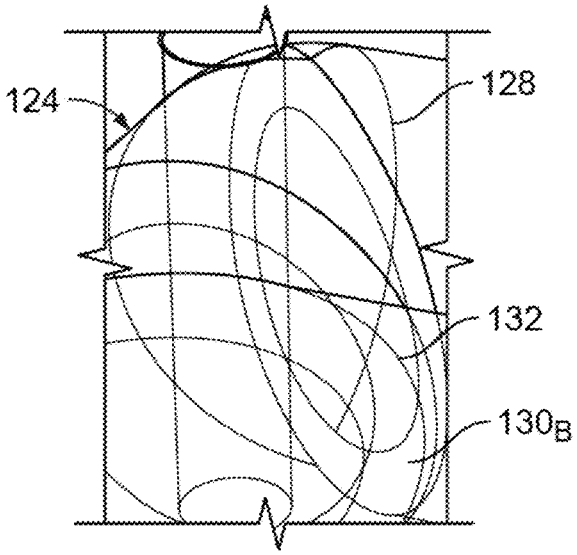
FIG. 13 is a partial, perspective view of the tank seen in FIG. 2 with the segments shown in phantom.
Figure 14:
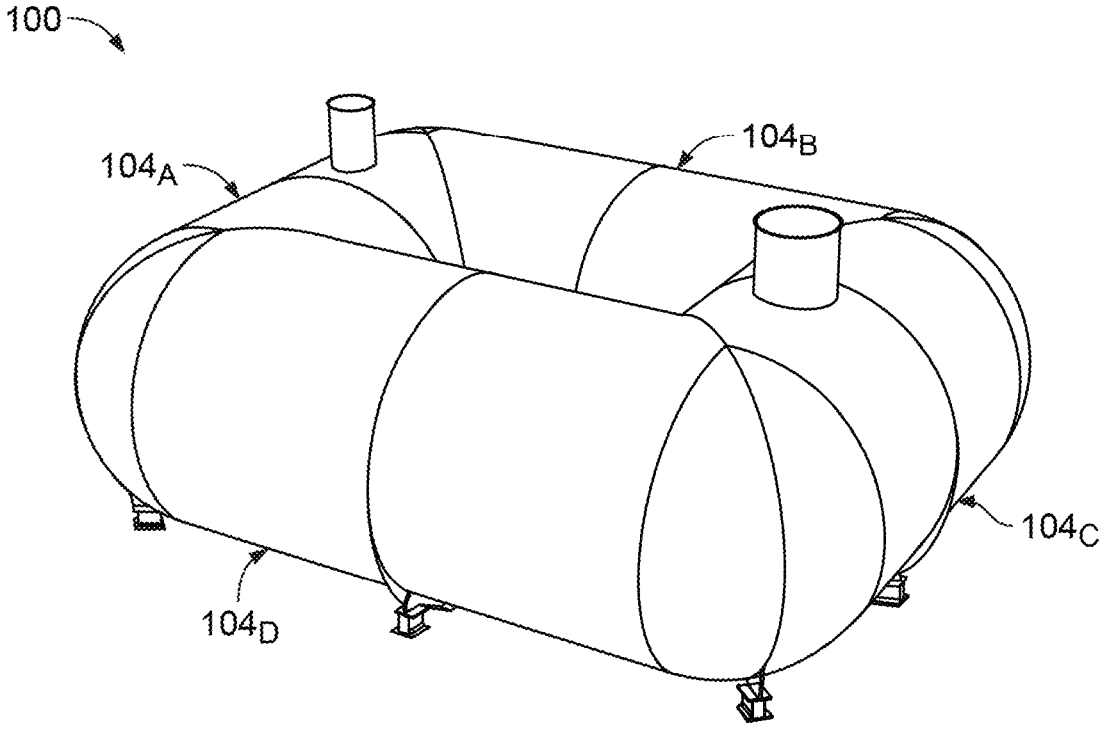
FIG. 14 is a top, perspective view of an alternate embodiment of the tank seen in FIG. 2.
Figure 15:
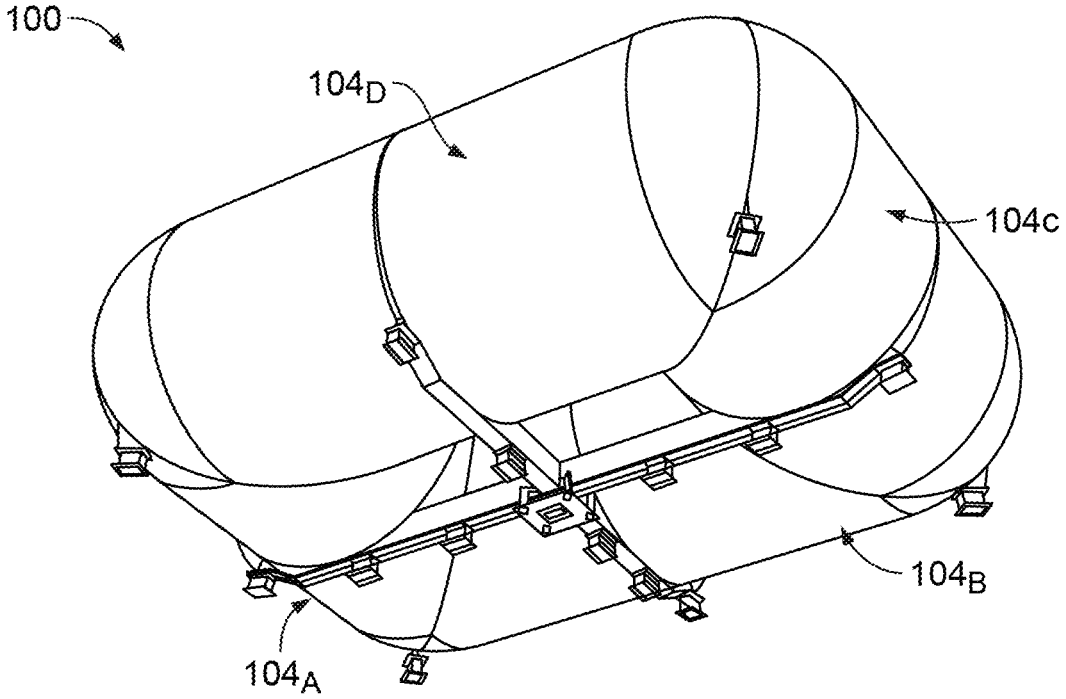
FIG. 15 is a bottom, perspective view of the tank seen in FIG. 14.
Figure 16:
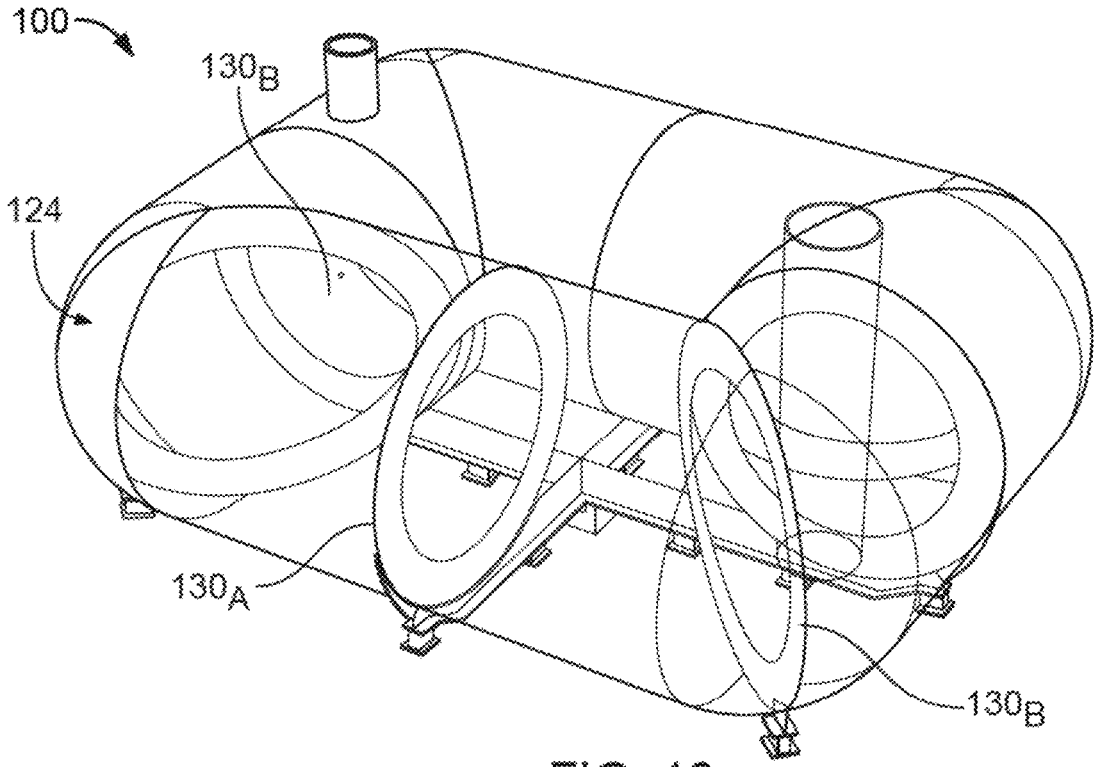
FIG. 16 is a top, perspective view of the tank seen in FIG. 14 with two segments shown in phantom.
Figure 17:
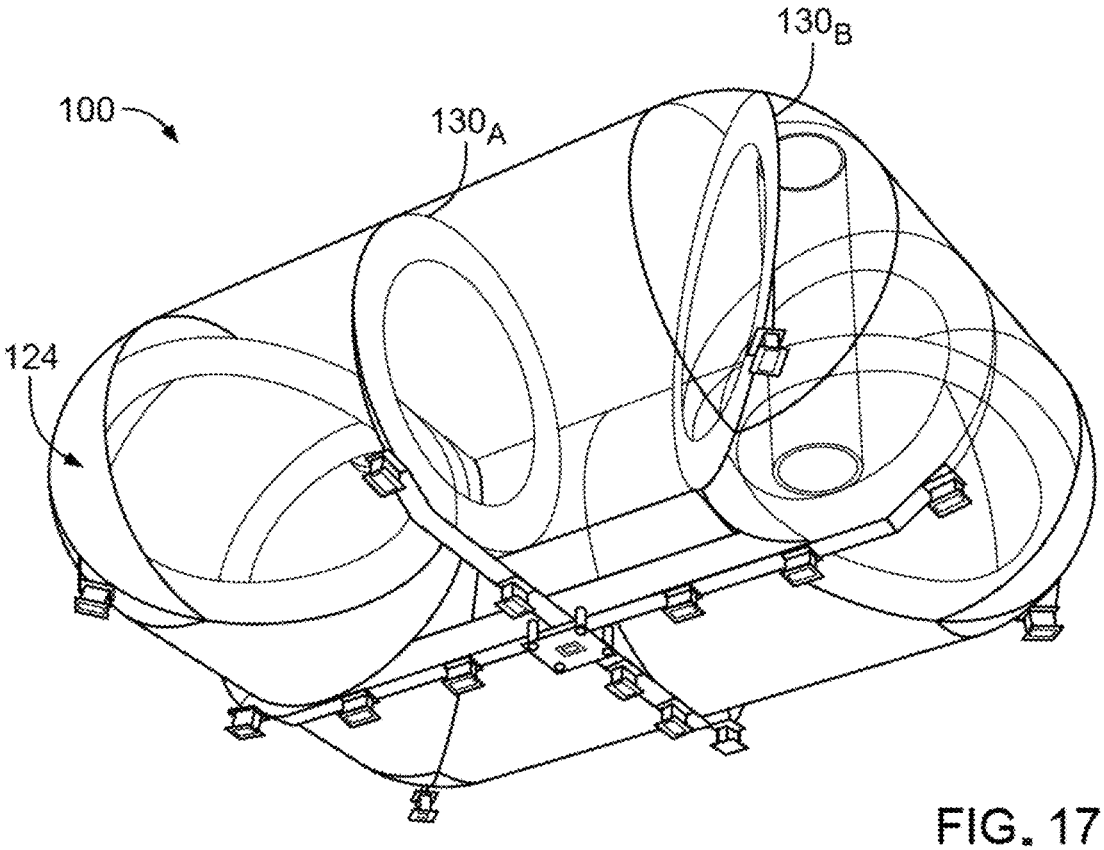
FIG. 17 is a bottom, perspective view of the tank seen in FIG. 14 with two segments shown in phantom.

With reference again to FIGS. 2-13, each of the tanks 100 further includes a plurality of endcaps 124 that are positioned between adjacent segments $\mathbf{104}_{A\text{-}D}$ to connect the segments $\mathbf{104}_A$-D. The endcaps 124 are generally arcuate in configuration and have an approximately quarter-spherical shape that includes a curved outer surface 126 (FIG. 3). As seen in FIGS. 8 and 11, each of the endcaps 124 defines a pair of mating surfaces 128. The mating surfaces 128 of each endcap 124 are configured and dimensioned for abutment with the mating surfaces $\mathbf{110}_{A\text{-}D}$ (FIG. 6) defined by the segments $\mathbf{104}_{A\text{-}D}$ of the tanks 100, as discussed in further detail below.

Although illustrated as being identical in configuration and dimensions in FIGS. 2-13, dependent upon the particular intended use of the tanks 100, an embodiment in which one or more of the endcaps 124 varies in configuration and/or dimensions would not be beyond the scope of the present disclosure, e.g., a series of endcaps 124 that vary in length.

Upon assembly of the tanks 100, the segments $\mathbf{104}_{A\text{-}D}$ are positioned such that the mating surfaces $\mathbf{112}_{A\text{-}D}$ (FIG. 6) of adjacent segments $\mathbf{104}_{A\text{-}D}$ are in abutment. Specifically, the segments $\mathbf{104}_{A\text{-}D}$ are positioned such that the mating surfaces $\mathbf{112}_A$ of segment $\mathbf{104}_A$ abut the mating surfaces $\mathbf{112}_B$, $\mathbf{112}_D$ of segments $\mathbf{104}_B$, $\mathbf{104}_D$, respectively, the mating surfaces $\mathbf{112}_B$ of segment $\mathbf{104}_B$ abut the mating surfaces $\mathbf{112}_A$, $\mathbf{112}_C$ of segments $\mathbf{104}_A$, $\mathbf{104}_C$, respectively, the mating surfaces $\mathbf{112}_C$ of segment $\mathbf{104}_C$ abut the mating surfaces $\mathbf{112}_B$, $\mathbf{112}_D$ of segments $\mathbf{104}_B$, $\mathbf{104}_D$, respectively, and the mating surfaces $\mathbf{112}_D$ of segment $\mathbf{104}_D$ abut the mating surfaces $\mathbf{112}_A$, $\mathbf{112}_C$ of segments $\mathbf{104}_A$, $\mathbf{104}_C$, respectively. Additionally, upon assembly of the tanks 100, the endcaps 124 are positioned in relation to the segments $\mathbf{104}_{A\text{-}D}$ such that the mating surfaces $\mathbf{110}_{A\text{-}D}$ (FIG. 6) abut the mating surfaces 128 (FIG. 8) defined by the endcaps 124, whereby structural continuity of the tanks 100 is increased under high pressure, i.e., to Type C tank standards, to meet ASME Section VIII pressure vessel stress levels. It is envisioned that the segments $\mathbf{104}_{A\text{-}D}$ and the endcaps 124 may be configured, dimensioned, and adapted, and that the tanks 100 may be assembled, to contain any boil-off-gas within the tanks 100, thereby eliminating the need for either a liquefaction unit or a combustion unit to simplify installation and reduce costs.

The segments $\mathbf{104}_{A\text{-}D}$ and the endcaps 124 may be secured together in any manner suitable for the intended purpose of storing and transporting fluids, e.g., LNG, such as through welding or any other such acceptable process.

As seen in FIGS. 4, 5, 9, 10, 12, and 13, in certain embodiments, the tanks 100 may further include one or more bulkheads or webs 130 to provide structural reinforcement, and thereby increase stability/rigidity of the tanks 100. The webs 130 may be positioned at intermittent locations within the segments $\mathbf{104}_{A\text{-}D}$, and may extend through, or may be otherwise connected with, interior surfaces of the segments $\mathbf{104}_{A\text{-}D}$. The webs 130 define apertures 132 that permit a restricted flow of fluid through therethrough, and are configured and dimensioned to extend above minimum fill levels in order to attenuate dynamic movement ("sloshing") of fluid within the tanks 100 during movement/transport. Further details regarding the webs 130 can be obtained through reference to the '990 publication.

In certain embodiments of the disclosure, the webs 130 may be identical in configuration and dimensions. In alternate embodiments, however, the tanks 100 may include webs 130 that vary in configuration and dimensions. For example, with reference to the embodiment of the tanks 100 illustrated in FIGS. 4, 5, 9, 10, 12, and 13, the webs 130 may include a series of first webs $\mathbf{130}_A$ that are generally annular in configuration and a series of second webs $\mathbf{130}_B$ that are more elongate, that is, are generally elliptical in configuration. As seen in FIGS. 4 and 5, for example, the webs $\mathbf{130}_A$ may be located within the segments $\mathbf{104}_{A\text{-}D}$ at locations between the endcaps 124, and the webs $\mathbf{130}_B$ may be positioned such that they extend into the endcaps 124 to thereby stiffen the endcaps 124 and reinforce the tanks 100 at the corners.

With respect to the particular location of the webs 130, it is envisioned that the webs $\mathbf{130}_A$ may be positioned in alignment with the transverse and longitudinal support members 120 of the base structure 118, as seen in FIGS. 4 and 5, for example, to create added structural support for the tanks 100. It is further envisioned that the webs $\mathbf{130}_B$ may be may be positioned on opposite sides of the engagement surfaces defined by abutment of the mating surfaces $\mathbf{112}_{A\text{-}D}$ (FIG. 6) of adjacent segments $\mathbf{104}_{A\text{-}D}$, or alternatively, that the webs $\mathbf{130}_B$ may be positioned between the mating surfaces $\mathbf{112}_{A\text{-}D}$ of adjacent segments $\mathbf{104}_{A\text{-}D}$, thereby separating the adjacent ends $\mathbf{106}_{A\text{-}D}$, $\mathbf{108}_{A\text{-}D}$, and thus, the segments $\mathbf{104}_{A\text{-}D}$. Accordingly, an embodiment of the tanks 100 is contemplated herein in which the adjacent segments $\mathbf{104}_{A\text{-}D}$ are separated by the webs $\mathbf{130}_B$ and the endcaps 124, and thus, are not in physical contact with one another.

In certain embodiments, it is envisioned that the webs 130 may extend beyond the outer surfaces of the segments $\mathbf{104}_{A\text{-}D}$ so as to provide a datum for the segments $\mathbf{104}_{A\text{-}D}$ to butt against, and thereby facilitate attachment via welding, or other such acceptable process, to aid in manufacturing and assembly of the tanks 100. By way of example, the webs 130 may extend vertically downward beyond the outer surface of the segments $\mathbf{104}_{A\text{-}D}$ to facilitate attachment of the webs 130 and/or the segments $\mathbf{104}_{A\text{-}D}$ to the base structure 118 (FIGS. 3, 5), and/or vertically upward beyond the outer surface of the segments $\mathbf{104}_{A\text{-}D}$ in those designs incorporating a roll or pitch restrictor (not shown).

With reference now to FIGS. 18-22, an alternate embodiment of tanks 200 will be described. The tanks 200 may be identical to the tanks 100 (FIGS. 1-13) described above but for the distinctions discussed below. Accordingly, in the interest of brevity, the tanks 200 will only be discussed in detail to the extent necessary to identify any differences in structure and/or function.

The tanks 200 include segments $\mathbf{204}_{A\text{-}D}$ with opposing ends $\mathbf{206}_{A\text{-}D}$, $\mathbf{208}_{A\text{-}D}$ (FIG. 22), and mating surfaces $\mathbf{212}_{A\text{-}D}$ that each extend at an angle β in relation to the longitudinal axes A-A, B-B, C-C, D-D of the corresponding segment $\mathbf{204}_{A\text{-}D}$ such that the mating surfaces $\mathbf{212}_{A\text{-}D}$ are beveled in configuration. In the particular embodiment of the tanks 200 seen in FIGS. 18-22, for example, the segments $\mathbf{204}_{A\text{-}D}$ are configured and dimensioned such that the angle θ is approximately 45°. It should be appreciated, however, that the configuration of the segments $\mathbf{204}_{A\text{-}D}$ may be varied in alternate embodiments of the disclosure to achieve any desired or suitable value for the angle β.

Figure 24:
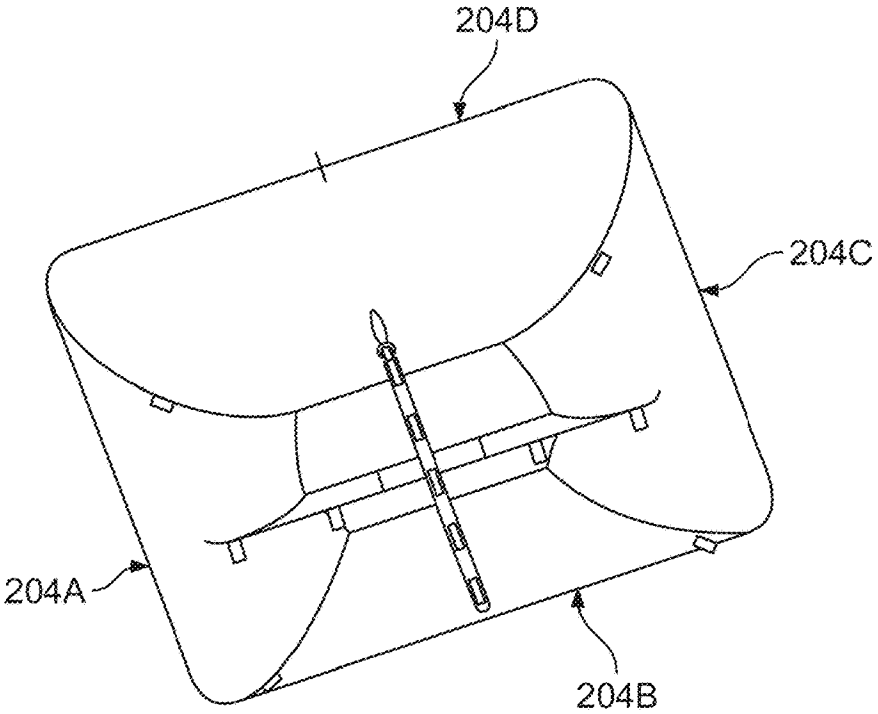
FIG. 24 is a bottom, perspective view of the tank seen in FIG. 23.
Figure 23:
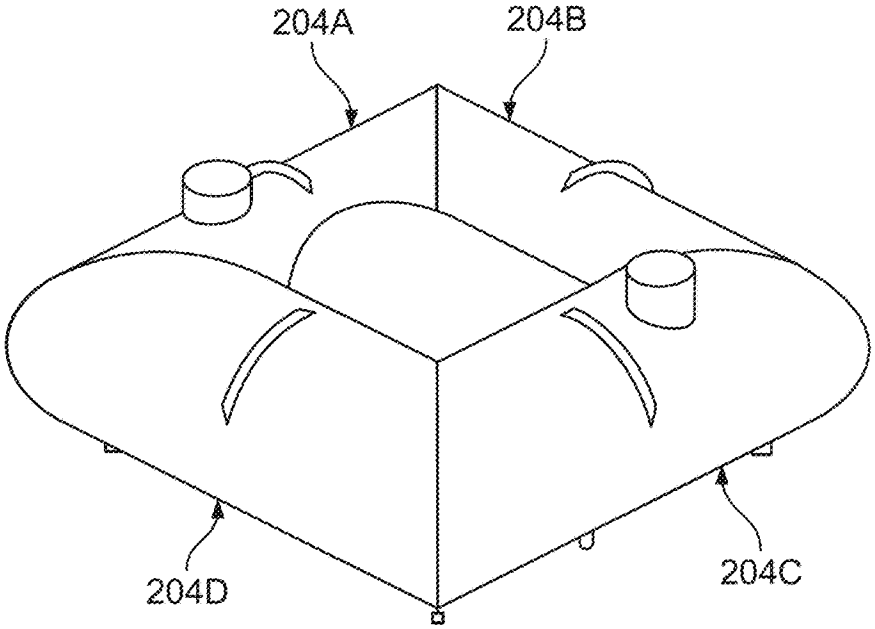
FIG. 23 is a top, perspective view of an alternate embodiment of the tank seen in FIG. 2.

In the particular embodiment of the tanks 200 shown in FIGS. 18-22, the lengths $L_B$, $L_D$ of the segments $\mathbf{204}_B$, $\mathbf{204}_D$ exceed the lengths $L_A$, $L_C$ of segments $\mathbf{204}_A$, $\mathbf{204}_C$, respectively, such that the tank 200 is generally "rectangular" in configuration. In alternate embodiments of the tanks 200, however, the dimensions of the segments $\mathbf{204}_{A\text{-}D}$ may be varied to achieve any desired result. For example, as seen in FIGS. 23 and 24, the tanks 200 may include segments $\mathbf{204}_{A\text{-}D}$ that are identical in configuration and dimensions, and thus, define equivalent lengths, such that the tanks 200 are generally "square-shaped" in configuration.

Figure 18:
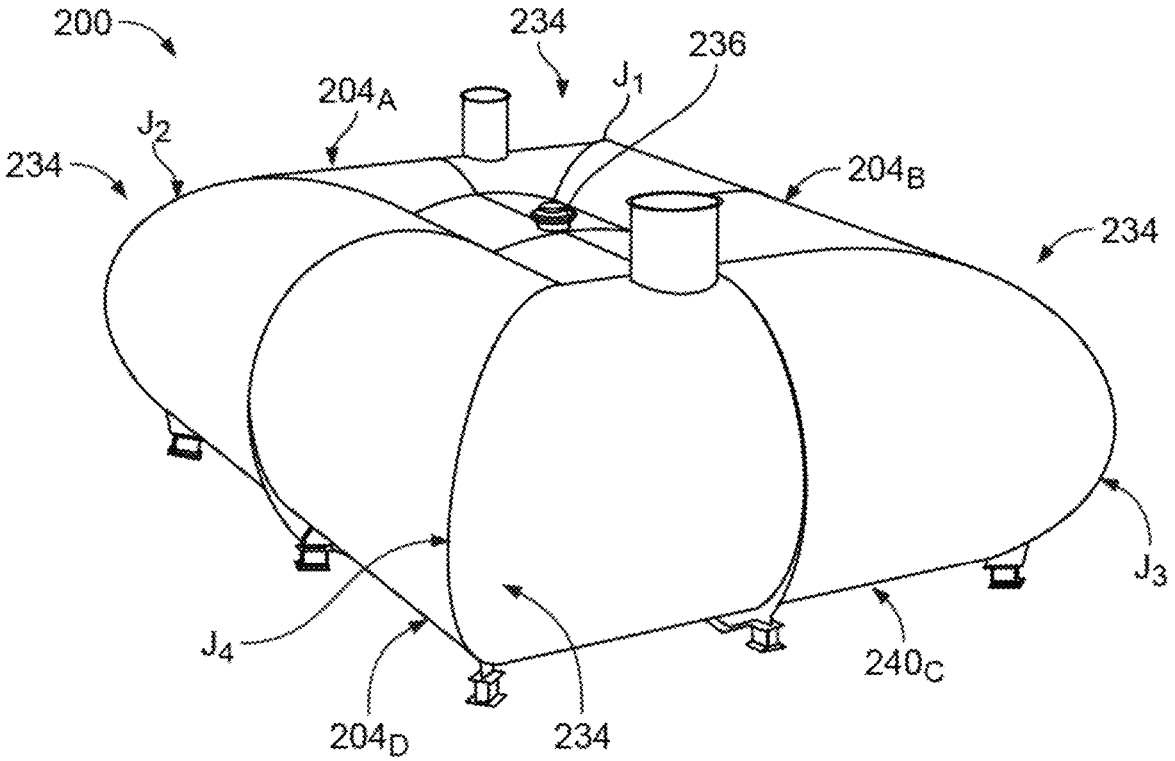
FIG. 18 is a top, perspective view of an alternate embodiment of the tank seen in FIG. 2.
Figure 19:
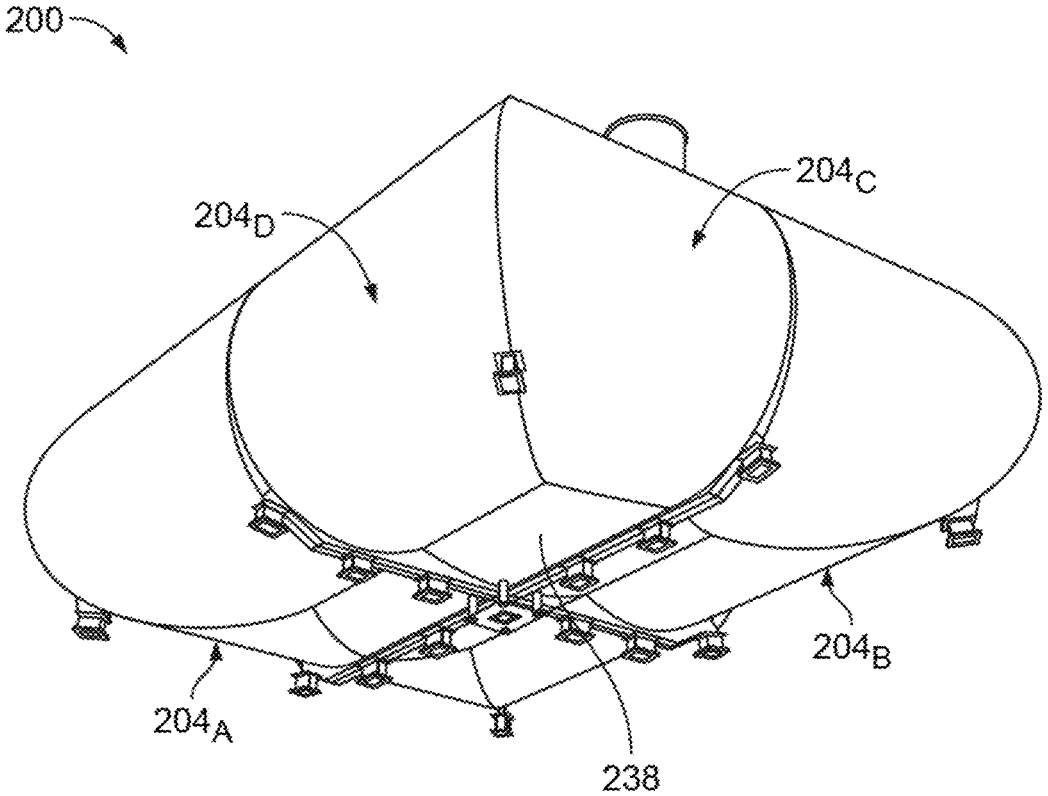
FIG. 19 is a bottom, perspective view of the tank seen in FIG. 18.

Upon assembly of the tanks 200, the segments $\mathbf{204}_{A\text{-}D}$ are positioned such that the mating surfaces $\mathbf{212}_{A\text{-}D}$ of adjacent segments $\mathbf{204}_{A\text{-}D}$ are in abutment to define corner sections 234 (FIG. 18). Specifically, the segments $\mathbf{104}_{A\text{-}D}$ are positioned such that the mating surfaces $\mathbf{212}_A$ (FIG. 22) of segment $\mathbf{204}_A$ abut the mating surfaces 212E and $\mathbf{212}_D$ of segments $\mathbf{204}_B$ and $\mathbf{204}_D$, respectively, to define junctures $J_1$ and $J_2$ (FIG. 18), the mating surfaces 212E of segment $\mathbf{204}_B$ abut the mating surfaces $\mathbf{212}_A$ and $\mathbf{212}_C$ of segments $\mathbf{204}_A$ and $\mathbf{204}_C$, respectively, to define a junctures $J_1$ and $J_3$, the mating surfaces $\mathbf{212}_C$ of segment $\mathbf{204}_C$ abut the mating surfaces $\mathbf{212}_B$ and $\mathbf{212}_D$ of segments $\mathbf{204}_B$ and $\mathbf{204}_D$, respectively, to define junctures $J_3$ and $J_4$, and the mating surfaces $\mathbf{212}_D$ of segment $\mathbf{212}_D$ abut the mating surfaces $\mathbf{212}_A$ and $\mathbf{212}_C$ of segments $\mathbf{204}_A$ and $\mathbf{204}_C$, respectively, to define junctures $J_2$ and $J_4$. As can be appreciated through reference to FIGS. 18-21, given the orientation of the segments $\mathbf{104}_{A\text{-}D}$ and the configuration and dimensions of the beveled mating surfaces $\mathbf{208}_{A\text{-}D}$, the junctures $J_{1\text{-}4}$ assume a generally elliptical cross-sectional configuration.

Given the direct connection of the mating surfaces $\mathbf{212}_{A\text{-}D}$, the tanks 200 obviate the need for the endcaps 124 discussed above in connection with the tanks 100 and may operate at a lower pressure, i.e., to Type B tank standards.

Figure 20:
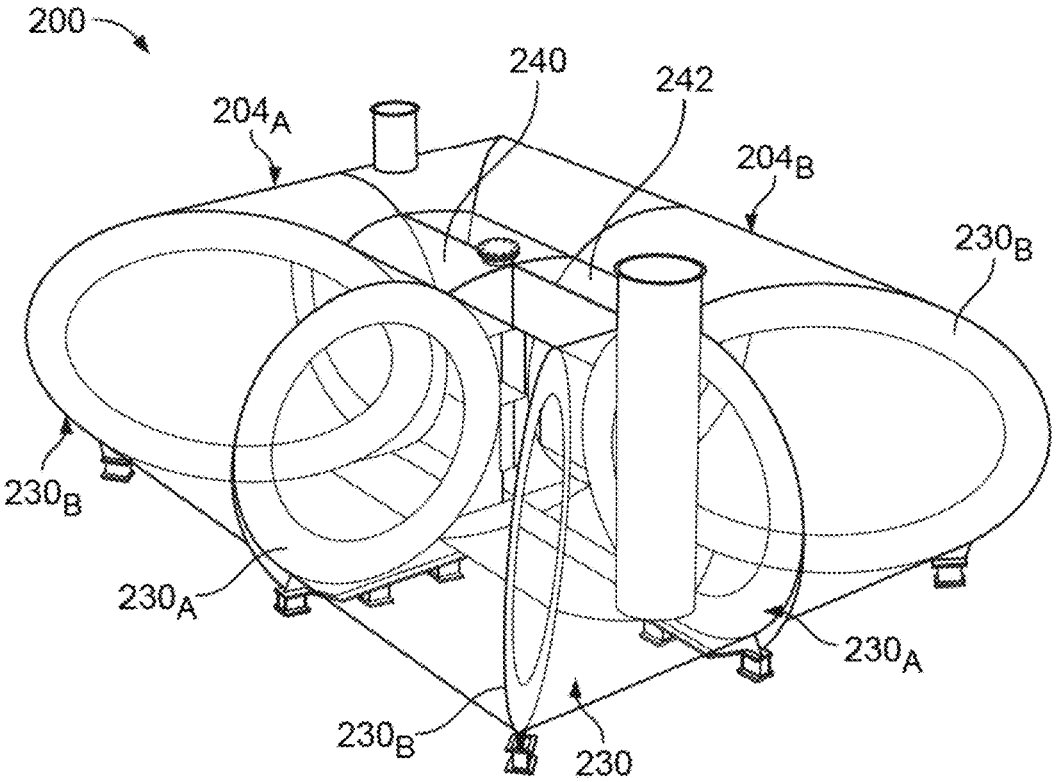
FIG. 20 is a top, perspective view of the tank seen in FIG. 18 with two segments shown in phantom.
Figure 21:
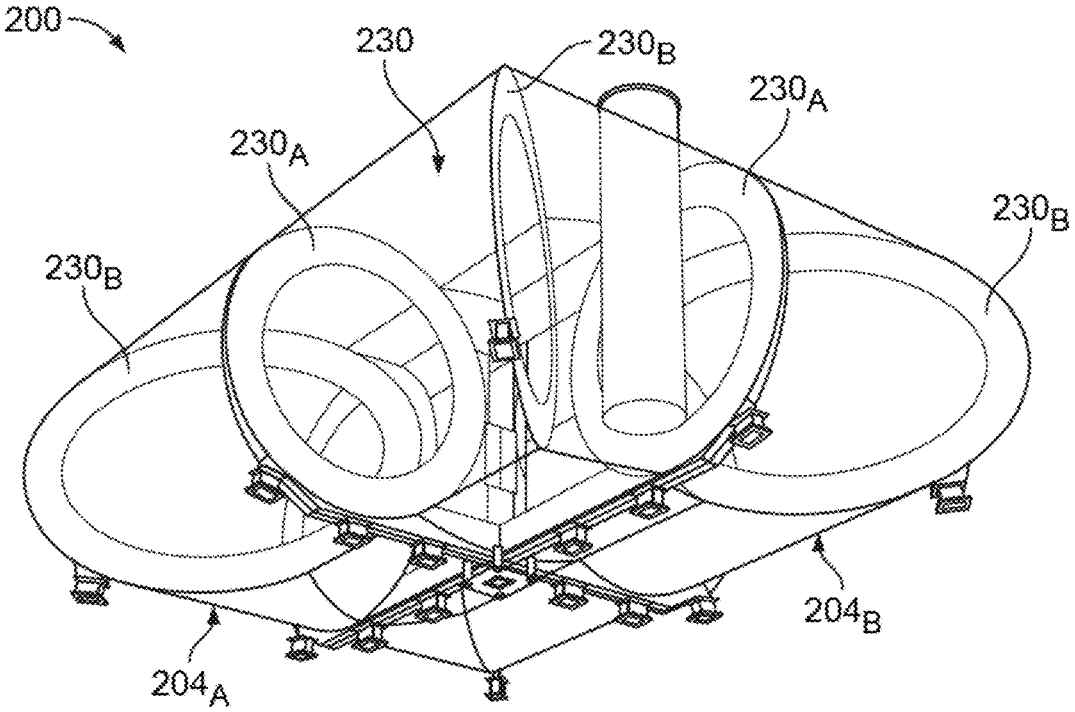
FIG. 21 is a bottom, perspective view of the tank seen in FIG. 18 with two segments shown in phantom.
Figure 22:
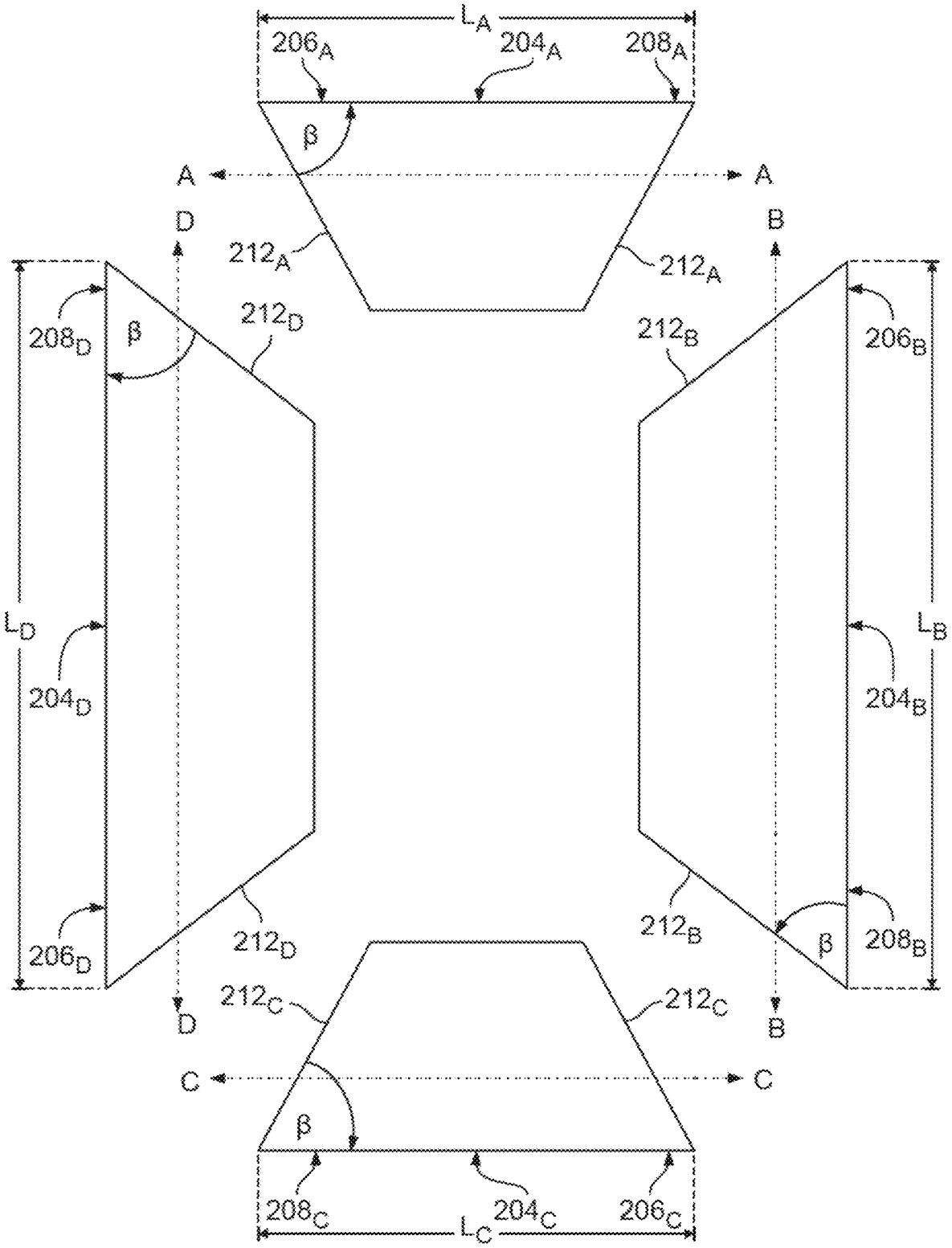
FIG. 22 is a partial, top, schematic view of the tank seen in FIG. 18 with the endcaps removed.

As seen in FIGS. 20 and 21, in certain embodiments, the tanks 200 may further include one or more webs 230. In certain embodiments, each of the webs 230 may be identical in configuration and dimensions. In alternate embodiments, however, the tanks 200 may include webs 230 that vary in configuration and dimensions. For example, with reference to the embodiment of the tanks 200 illustrated in FIGS. 20 and 21, for example, the webs 230 may include a series of webs $\mathbf{230}_A$ that are generally annular in configuration, and a series of webs $\mathbf{230}_B$ that are more elongate and generally elliptical in configuration. In such embodiments, the webs $\mathbf{230}_A$ may be located within the segments $\mathbf{204}_{A\text{-}D}$ at locations between the corner sections 234, and the webs $\mathbf{230}_B$ may be positioned either at the junctures $J_{1\text{-}4}$, or adjacent thereto, to thereby stiffen and reinforce the tanks 200 at the corner sections 234.

The tanks 200 further include an upper closure plate 236 (FIG. 18) and a lower closure plate 238 (FIG. 19) that are separated by a vertical distance and enclose an interior cavity 240 (FIG. 20) it is envisioned that the tanks 200 may include a directional mechanism 242 (FIG. 20), such as a valve or an access hatch.

To facilitate processing of the boil-off-gas collected in the interior cavity 240, the tanks 200 may further include a dome near the highest point on the forward transverse cylinder, and may be in communication with, a liquefaction unit (not shown) and/or a gas combustion unit (not shown).

With reference now to FIGS. 1-26, the tanks that are the subject of the present disclosure, e.g., the aforedescribed tanks 100, 200, will be discussed in the context of known containment, transport, and/or storage systems, such as the CDTS tank systems described in the '990 publication and the bi-lobe and cylindrical tanks "B" and "C" respectively seen in FIGS. 25 and 26, to highlight certain advantages and benefits offered by the tanks 100, 200.

Known CDTS tank systems, such as those described in the '990 publication, are of significantly greater size than the tanks 100, 200, often including twelve intersecting segments/cylinders arranged into two (horizontal) stacked rows of four segments/cylinders that are vertically connected by four additional segments/cylinders. Known CDTS tank systems are thus typically "cubical" in configuration, and given their size, often require exterior reinforcement, bracing, and/or stabilizing members, e.g., to secure the tanks to the vessel carrying them, as described in the '990 publication.

In contrast, the presently disclosed tanks 100, 200 lie in a single horizontal plane via elimination of the "upper row" of segments/cylinders and the vertical connecting segments/cylinders. The presently disclosed tanks 100, 200 thus have a center of gravity that is comparatively much closer to the surface supporting the tanks 100, 200, eliminating the need for exterior reinforcement, bracing, and/or stabilizing members, and thereby simplifying installation and maintenance to reduce operating costs.

The reduced height and overall size of the presently disclosed tanks 100, 200 also provides for greater flexibility in location on a particular vessel, allowing the tanks 100, 200 to be situated in areas of reduced space, and used in a wider variety of vessels, such as smaller tankers that could not accommodate known CDTS tank systems. Moreover, the reduced height and overall size of the presently disclosed tanks 100, 200 eliminates the need to plan or build a holding space around the tanks 100, 200, allowing for the installation of completed tanks 100, 200 in potentially more advantageous or desirable locations on a vessel. This flexibility also allows for a reduction in time when retrofitting a vessel to either replace an existing CDTS tank system with the tanks 100, 200 of the present disclosure, or converting a vessel to carry LNG fuel.

Figure 25:
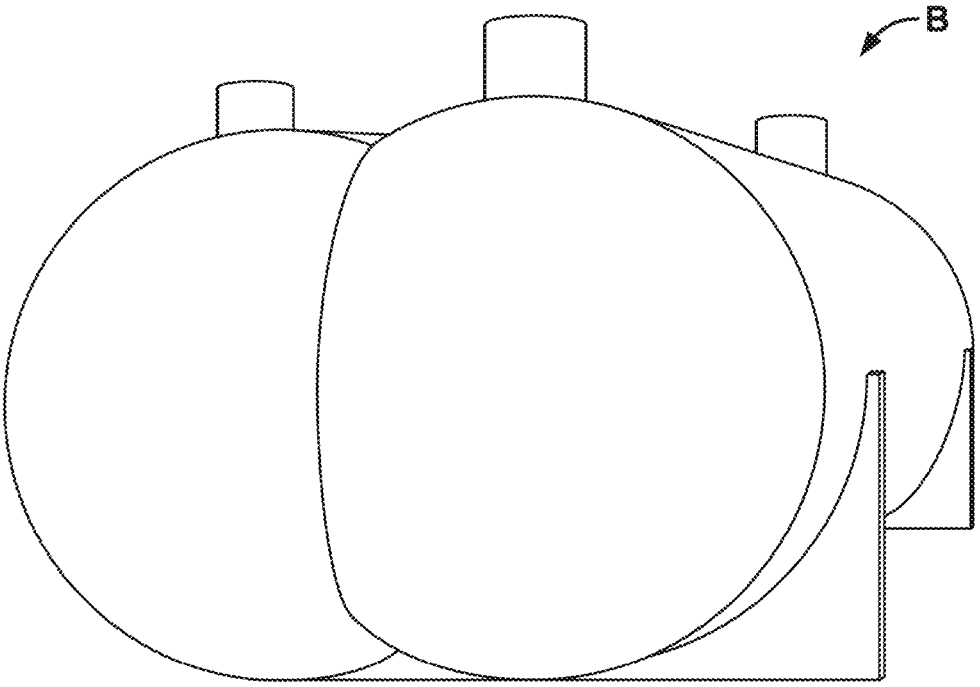
FIG. 25 is an end, perspective view of an example of a known bi-lobe tank.
Figure 26:
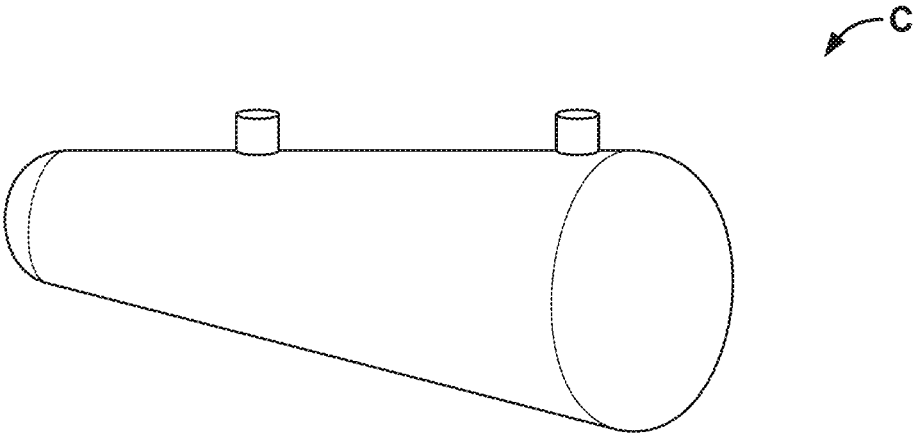
FIG. 26 is a side, perspective view of an example of a known cylindrical tank.

In contrast to the bi-lobe tank "B" seen in FIG. 25 and the cylindrical tank "C" seen in FIG. 26, the design of the presently disclosed tanks 100, 200 allow for the use of segments $\mathbf{104}_{A\text{-}D}$, $\mathbf{204}_{A\text{-}D}$, respectively, that are smaller in diameter without any sacrifice in storage volume. For example, the segments $\mathbf{104}_{A\text{-}D}$, $\mathbf{204}_{A\text{-}D}$ respectively used in construction of the tanks 100, 200 may be 20%-30% smaller in diameter when compared to bi-lobe tanks "B," and 10%-20% smaller in diameter when compared to cylindrical tanks "C." This reduction in diameter, and the use of an uninterrupted cylindrical segment, allows for a corresponding reduction in the shell thickness of the segments $\mathbf{104}_{A\text{-}D}$, $\mathbf{204}_{A\text{-}D}$, and a resultant weight reduction of 10% or more. Additionally, the design of the tanks 100, 200 allows for a 20%-30% reduction in overall height without any compromise in storage capacity, thereby facilitating vessel conversion/retrofit, as well as use of the tanks 100, 200 in a wider variety of vessels, e.g., smaller vessels, as discussed above. Moreover, the presently disclosed tanks 100, 200 permit a reduction in circumscribing volume when compared to cylindrical tanks, such as the tank "C" seen in FIG. 26, of 10% or more.

Persons skilled in the art will understand that the various embodiments of the disclosure described herein, and shown in the accompanying figures, constitute non-limiting examples, and that additional components and features may be added to any of the embodiments discussed herein above without departing from the scope of the present disclosure. Additionally, persons skilled in the art will understand that the elements and features shown or described in connection with one embodiment may be combined with those of another embodiment without departing from the scope of the present disclosure, and will appreciate further features and advantages of the presently disclosed subject matter based on the description provided. Variations, combinations, and/or modifications to any of the embodiments and/or features of the embodiments described herein within the abilities of a person having ordinary skill in the art are also within the scope of the disclosure, as are alternative embodiments that may result from combining, integrating, and/or omitting features from any of the disclosed embodiments.

Where numerical ranges or limitations are expressly stated, such express ranges or limitations should be understood to include iterative ranges or limitations of like magnitude falling within the expressly stated ranges or limitations, e.g., from about 1 to about 10 includes 2, 3, 4, etc., and greater than 0.10 includes 0.11, 0.12, 0.13, etc. Additionally, whenever a numerical range with a lower limit, $L_L$, and an upper limit, $L_U$, is disclosed, any number falling within the range is specifically disclosed. In particular, the following numbers within the range are specifically disclosed: $L=L_L+k*(L_U-L_L)$, wherein k is a variable ranging from 1 percent to 100 percent with a 1 percent increment, i.e., k is 1 percent, 2 percent, 3 percent, 4 percent, 5 percent, 50 percent, 51 percent, 52 percent, . . . , 95 percent, 96 percent, 95 percent, 98 percent, 99 percent, or 100 percent. Moreover, any numerical range defined by two L numbers, in accordance with the above discussion, is also specifically disclosed.

Use of the term "optionally" with respect to any element of a claim means that the element may be included or omitted, both alternatives being within the scope of the claim. Additionally, use of broader terms such as "comprises," "includes," and "having" should be understood to provide support for narrower terms such as "consisting of," "consisting essentially of," and "comprised substantially of" Accordingly, the scope of protection is not limited by the description set out above, but is defined by the claims that follow, and includes all equivalents of the subject matter of the claims.

In the preceding description, reference may be made to the spatial relationship between the various structures illustrated in the accompanying drawings, and to the spatial orientation of the structures. However, as will be recognized by those skilled in the art after a complete reading of this disclosure, the structures described herein may be positioned and oriented in any manner suitable for their intended purpose. Thus, the use of terms such as "above," "below," "upper," "lower," "inner," "outer," etc., should be understood to describe a relative relationship between structures, and/or a spatial orientation of the structures.

Additionally, terms such as "approximately" and "generally" should be understood to allow for variations in any numerical range or concept with which they are associated. For example, it is envisioned that the use of terms such as "approximately" and "generally" should be understood to encompass variations on the order of 25%, or to allow for manufacturing tolerances and/or deviations in design.

Each and every claim is incorporated as further disclosure into the specification, and represent embodiments of the present disclosure. Also, the phrases "at least one of A, B, and C" and "A and/or B and/or C" should each be interpreted to include only A, only B, only C, or any combination of A, B, and C.

What is claimed is:

1. A tank comprising:

a plurality of segments in fluid communication and collectively defining an interior chamber configured and dimensioned to retain a fluid therein, each of the segments including opposing ends, each of the opposing ends defining a first mating surface having a beveled configuration;

a plurality of endcaps in engagement with the plurality of segments, each of the endcaps being positioned between adjacent segments; and a plurality of webs each defining an aperture configured and dimensioned to permit flow of the fluid through the aperture, the plurality of webs including a series of first webs having a first configuration and a series of second webs having a second, different configuration, the first webs being positioned within the plurality of segments between the opposing ends thereof, and the second webs being positioned within the endcaps.

2. The tank of claim 1, wherein the second webs and the endcaps correspond in number, each endcap including a second web positioned therein.

3. The tank of claim 2, wherein the first webs are approximately annular in configuration, and the second webs are approximately elliptical in configuration.

4. The tank of claim 3, wherein the endcaps define a configuration that is approximately quarter-spherical.

5. The tank of claim 4, wherein each of the opposing ends further define a second mating surface, the first mating surface extending at a first angle in relation to a longitudinal axis of the corresponding segment, and the second mating surface extending at a second, different angle in relation to a longitudinal axis of the corresponding segment.

6. The tank of claim 5, wherein each of the endcaps define mating surfaces configured and dimensioned in correspondence with the second mating surfaces defined by the opposing ends of the adjacent segments.

7. The tank of claim 6, wherein the first angle is approximately 45°.

8. The tank of claim 7, wherein the second angle is approximately 90°.

9. The tank of claim 1, wherein the plurality of segments includes a first pair of segments each defining a first length, and a second pair of segments each defining a second length, and wherein the first and second lengths are approximately equal such that the tank defines an approximately square-shaped transverse cross-sectional configuration.

10. The tank of claim 1, wherein the plurality of segments includes a first pair of segments each defining a first length, and a second pair of segments each defining a second length, and wherein the second length is greater than the first length such that the tank defines an approximately rectangular transverse cross-sectional configuration.

11. The tank of claim 1, wherein each segment defines a midpoint, the tank being configured such that each of the midpoints lies in a single geometric plane.

* * * * *